United States Patent [19]

David

[11] Patent Number: 4,672,813

[45] Date of Patent: Jun. 16, 1987

[54] EXTERNAL COMBUSTION SLIDABLE VANE MOTOR WITH AIR CUSHIONS

[76] Inventor: Constant V. David, 4952 Field St., San Diego, Calif. 92110

[21] Appl. No.: 866,945

[22] Filed: May 27, 1986

Related U.S. Application Data

[63] Continuation-in-part of Ser. No. 789,451, Oct. 21, 1985, Pat. No. 4,653,274, which is a continuation-in-part of Ser. No. 586,812, Mar. 6, 1984, Pat. No. 4,561,252.

[51] Int. Cl.[4] ..... F02B 71/04

[52] U.S. Cl. ..... 60/595; 418/92; 418/99; 418/129; 384/111

[58] Field of Search ..... 60/595; 123/204, 236, 123/237; 418/91, 92, 97, 98, 99, 129; 384/99, 109, 111

[56] References Cited

U.S. PATENT DOCUMENTS

| | | | |
|---|---|---|---|
| 3,057,157 | 10/1962 | Close | 123/204 X |
| 3,339,670 | 9/1967 | McGrew et al. | 418/99 X |
| 3,502,920 | 3/1970 | Chaboseau | 384/99 X |
| 3,744,942 | 7/1973 | Mount | 418/99 X |
| 3,989,011 | 11/1976 | Takahashi | 123/204 |

FOREIGN PATENT DOCUMENTS

| | | | |
|---|---|---|---|
| 1401401 | 10/1968 | Fed. Rep. of Germany | 418/92 |
| 2818278 | 11/1979 | Fed. Rep. of Germany | 123/204 |

*Primary Examiner*—Michael Koczo

[57] ABSTRACT

A slidable vane motor is used in conjunction with an externally located combustion member in which fuel is burned and compresses air for delivery to the combustion member and expands the combusted gas resulting from the fuel combustion in the compressed air. The vane motor and combustion member thus cooperate to form an external combustion engine. The energy extracted from the expansion of the gas is greater than the energy required to compress the air. The energy difference is delivered by a drive shaft external to the engine. The motor vanes slide quasi radially in guiding slots as the motor rotates to cause volumes of air trapped between contiguous vanes to decrease and trapped volumes of gas to increase concurrently. The vanes are thus subjected to pressure differentials which are applied quasi normally onto the vane sliding surfaces. The resulting torque is reacted by the action of high pressure air cushions located between the cooperating surfaces of the vanes and their slots. Physical contacts between the vanes and the slots is thus prevented. A similar use of air cushions is made to eliminate friction between the vane edges, other moving parts of the motor and those parts of the motor which are fixed.

13 Claims, 19 Drawing Figures

FIG. 1
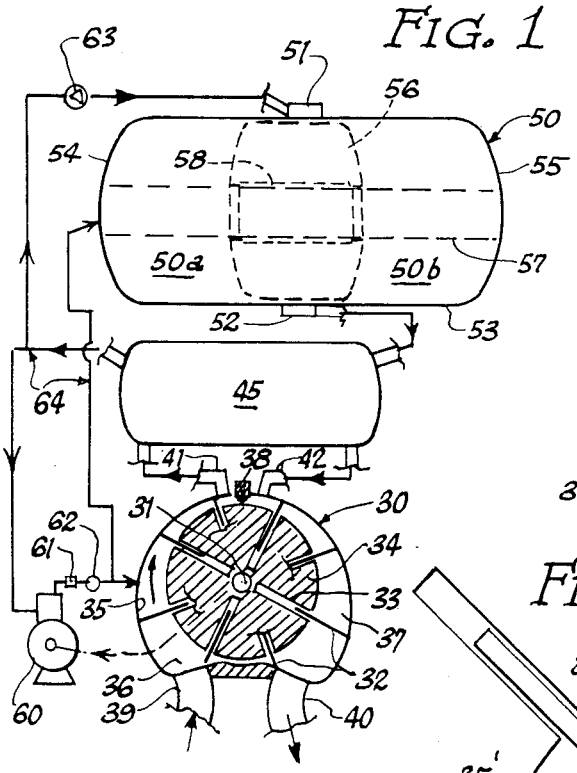
FIG. 2
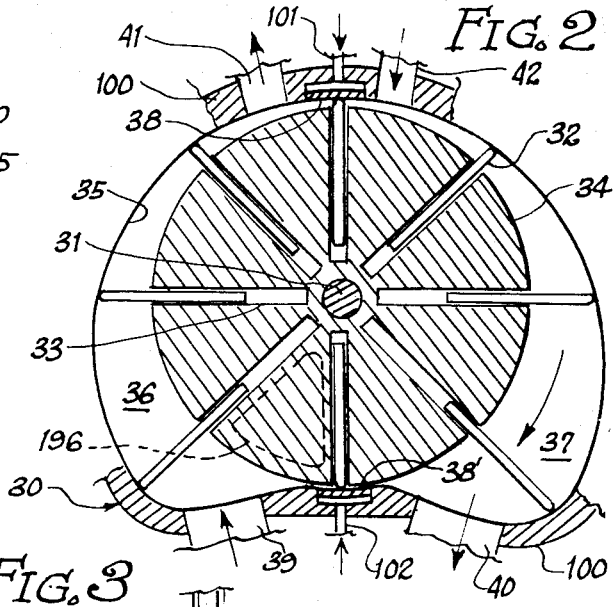
FIG. 3
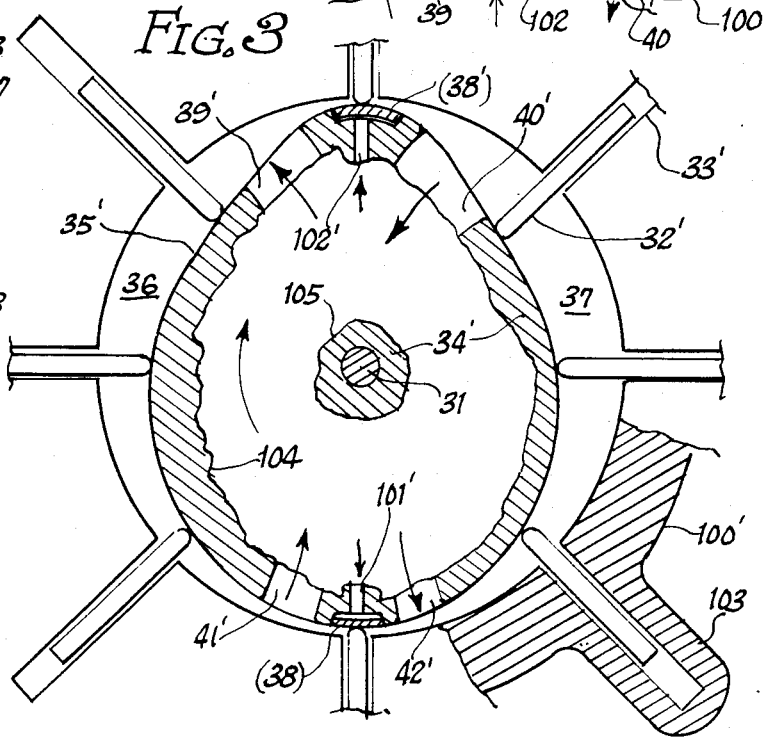
FIG. 5
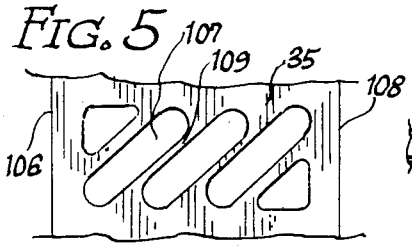
FIG. 13
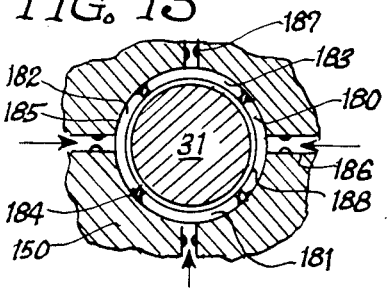
FIG. 16
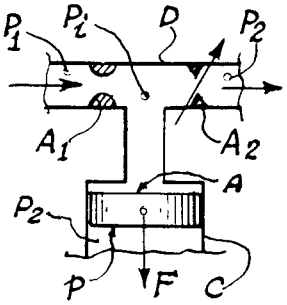
FIG. 17
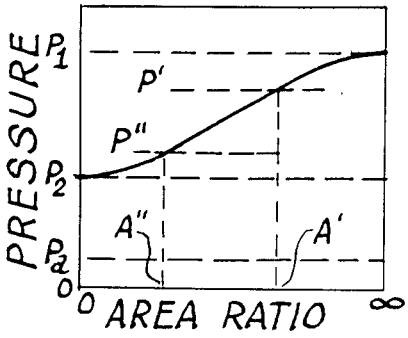
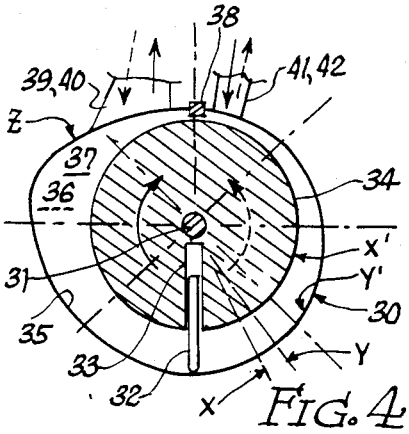
FIG. 4

FIG. 6
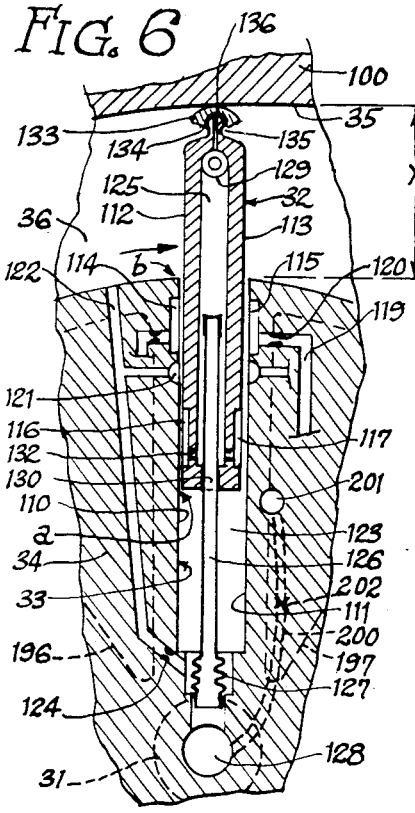
FIG. 7
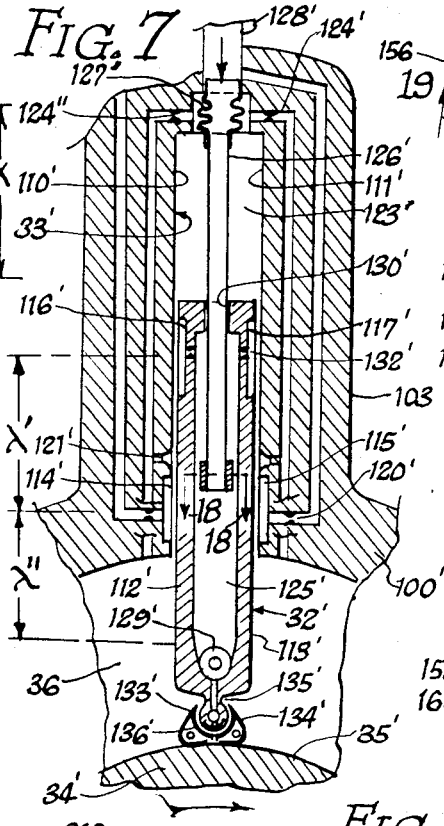
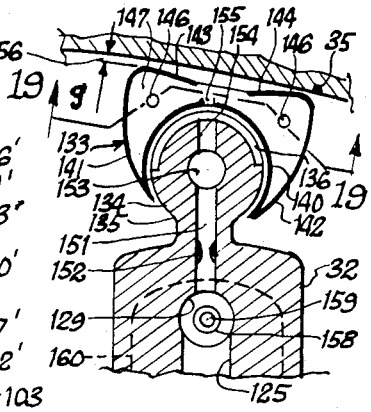
FIG. 8
FIG. 9
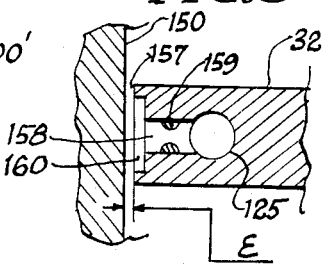
FIG. 14
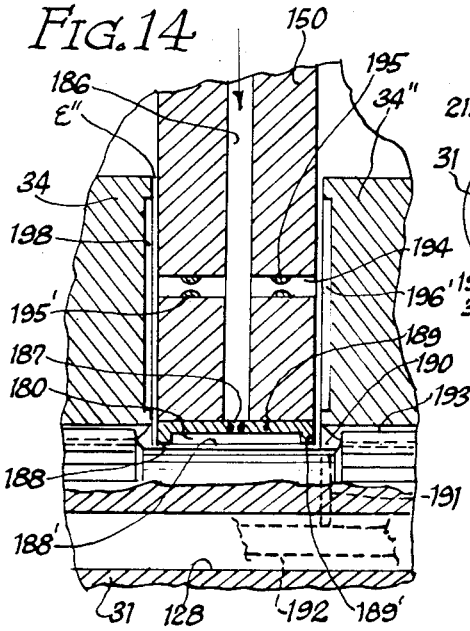
FIG. 15
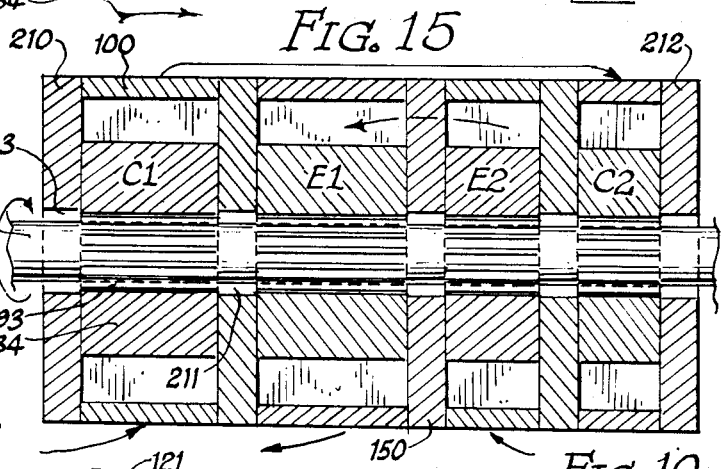
FIG. 10
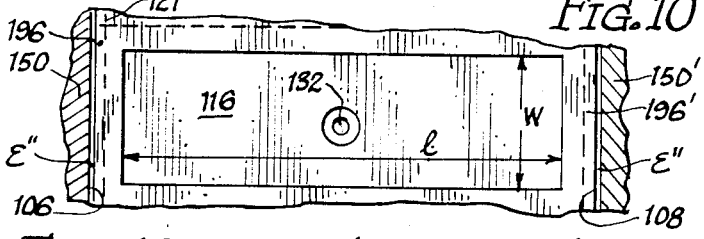
FIG. 11
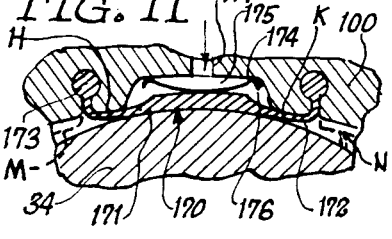
FIG. 12
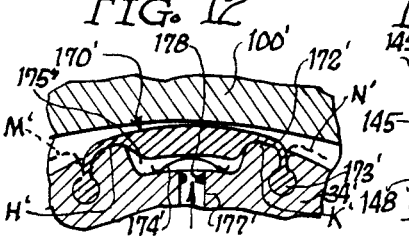
FIG. 19
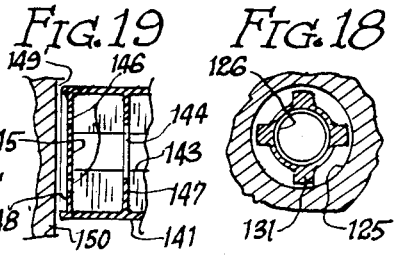
FIG. 18

EXTERNAL COMBUSTION SLIDABLE VANE MOTOR WITH AIR CUSHIONS

CROSS-REFERENCE TO RELATED APPLICATIONS

This application is a continuation-in-part of my prior pending application Ser. No. 789,451, filed Oct. 21, 1985, now U.S. Pat. No. 4,653,274, which in turn was a continuation-in-part of my prior application Ser. No. 586,812 filed Mar. 6, 1984 and entitled EXTERNAL COMBUSTION ENGINE which resulted in U.S. Pat. No. 4,561,252 dated Dec. 31, 1985 and entitled FREE PISTON EXTERNAL COMBUSTION ENGINES.

BACKGROUND OF THE INVENTION

The present invention relates to a vane motor used in conjunction with a combustion member where fuel burning occurs externally to the motor. The association of such motor with the external combustion member basically constitutes the external combustion engine. Such association is described and discussed in detail in my U.S. Pat. No. 4,399,654 dated Aug. 23, 1983, where a slidable vane motor and variations thereof are utilized: (1) for compressing air, (2) for expanding combusted gas and extracting energy therefrom, and (3) for producing energy delivered by an externally located power shaft.

The vanes of such motor must slide in and out of guiding slots as the motor rotates. The vanes are solicited to tilt by the pressure difference applied on their surfaces. The resulting torques must be reacted by the guiding surfaces of their corresponding slots. Friction between the cooperating sliding surfaces of both vanes and slots is conducive to wear. Lubrication of the sliding surfaces is difficult and results in the production of undesirable carbonaceous deposited by-products. The operating temperatures of the parts are high and cooling is not practical. However, the simplicity of a vane motor is appealing and efforts to develop vane motors which require neither lubrication nor cooling is considered very worthwhile in the case of the present application.

When fuel combustion is performed externally, the motor parts and especially the vanes are not subjected to the rapidly varying pressures, or even shocks, which combustion often causes. In addition, the magnitude of temperature gradients in moving parts is also lessened. Newer materials such as ceramics and densified carbon/graphite composites are being developed. They offer the advantages of high temperature resistance combined with low thermal expansion. Thus, they allow the elimination of cooling. The next step is to attempt to eliminate friction, thereby lubriction and sliding surface wear.

In view of this background, it is an object of the present invention to provide a new and improved vane motor for an external combustion engine which combines construction features that enables the motor to operate without cooling and lubrication.

It is another object of the present invention to prevent moving motor parts from contacting non-moving parts during the engine operation so as to prevent part wear.

It is another object of the present invention to provide air cushions between moving and fixed parts of the motor.

It is another object of the present invention to cause the air cushions to self-regulate the pressure of the air inside the cushions so as to create automatic feedback between moving part off-centering and the restoring actions of the air cushions.

Finally it is still another object of the present invention to provide a new and improved slidable vane motor for use with an external combustion member so as to minimize the magnitude of the mechanical and thermal loads imposed by the combustion process on the moving parts of the slidable vane motor.

SUMMARY OF THE INVENTION

The above objects are retained by an external combustion engine utilizing a vane motor in which combustion does not occur, as the latter takes place outside the motor confines. The motor functions are then reduced to those of air compression, combusted gas expansion and shaft power extraction.

Accordingly, the present invention provides a slidable vane motor for performing the above-mentioned three functions. Combusted gas and compressed air are momentarily stored in a storage tank located between the motor and the combustion member so as to facilitate the exchange of heat between the two fluids. The operating temperatures of the combusted gas introduced in the motor are thus reduced and the engine thermal efficiency is improved by a corresponding amount. The sliding vanes are isolated by air cushions fron their mechanical guides and supports. The rotating vane guiding and supporting structures are also isolated from the fixed structures of the motor by air cushions. The air needed for the air cushions represents a small fraction of the compressed air delivered by the motor and is further compressed to a higher pressure level so as to always be at a pressure substantially higher than the peak pressures reached by the working fluids inside the motor at any and all times.

DESCRIPTION OF THE DRAWINGS

FIG. 1 is a diagrammatic view of the vane motor shown connected to the engine combustion member and storage tank.

FIG. 2 is a schematic sectional view of a typical slidable vane motor in which the vanes are guided in a rotating central body, providing both air compression and gas expansion.

FIG. 3 is a schematic sectional view of a typical slidable vane motor in which the vanes are guided in a fixed outer body.

FIG. 4 is a schematic diagram of a construction variant of the vane motor of FIG. 2 in which either air compression or gas expansion is performed exclusively in each stage.

FIG. 5 is a developed plan view of an arrangement of typical ports for venting air or gas in and out of the motor.

FIG. 6 is a detailed sectional view of a slidable vane installed in a slot of rotating central body.

FIG. 7 is a detailed sectional view of a slidable vane installed in a slot of a fixed outer body.

FIG. 8 is a blown-up sectional view of the tilting air caster mounted on the vane free edge.

FIG. 9 is a blown-up sectional view of the side edges of a vane showing a typical air cushion side pad.

FIG. 10 is a partial plan view of the face of a vane showing a typical air cushion face pad.

FIG. 11 is a detailed sectional view of a seal shown installed on the inner surface of the fixed outer body.

FIG. 12 is a detailed sectional view of a seal shown installed on the outer surface of the rotating central body.

FIG. 13 is a schematic cross-sectional view of an air cushion journal shown supporting the motor shaft.

FIG. 14 is a partial elevation sectional view of an air cushion journal shown between two contiguous central bodies.

FIG. 15 is a diagrammatic schematic of a longitudinal sectional view of an assembly of two stages for air compression and combusted gas expansion and connections therefor.

FIG. 16 is a diagrammatic illustration of the principle of the operation of a pressurized air cushion pad.

FIG. 17 is a graphic representation of the pressure variations during an air cushion operation.

FIG. 18 is a cross-sectional view of a vane air duct guide, taken along section line 18—18 of FIG. 7.

FIG. 19 is a sectional view of one end of a vane tilting air caster showing its air cushion end pad, taken along section line 19—19 of FIG. 8.

DETAILED DESCRIPTION OF THE INVENTION

Referring to FIG. 1 of the drawings, an external combustion engine typically comprises a motor 30, a storage-tank/heat-exchanger combination. 45 and a combustion member 50. The equipment accessories needed for the engine operation include a compressor 60, an air filter 61, a pressure regulator 62, a check valve 63 and a set of connecting lines such as 64. Compressor 60 is shown driven by power shaft 31 of motor 30 and receives compressed air from storage tank 45 for further compression and delivery to the motor and the combustion member for use in various air cushions. Motor 30 generally consists of a plurality of sliding vanes 32 reciprocating in cooperating guiding slots 33 between a central body 34 and a track surface 35. Compression chamber 36 is separated from expansion chamber 37 by seal 38 which assures the continuity of track surface 35. Ambient air is admitted through manifold 39 and combusted gas exhaust through exhaust pipe 40. Compressed air exhausts through duct 41 into one portion of tank 45 and combusted gas is introduced through duct 42 from another portion of that tank.

Compressed air is introduced in combustion chambers 50*a* and 50*b* of combustion member 50 from tank 45 through inlet valving means 51 serving both chambers. Combusted gas exhausts through outlet valving means 52 from those combustion chambers for ducting to tank 45. The combustion member comprises a sleeve 53 closed at both ends by end closures 54 and 55, a free piston 56 reciprocating therein between the end closures, alternatively forming the two combustion chambers. Piston 56 may be guided radially by a hollow shaft 57 and is caused to rotatively oscillate in combination with its axial motion. The means used for imposing this coordinated dual motion is not shown here but is fully described in my U.S. Pat. Nos. 4,399,654 and 4,561,252. The means for introducing fuel and igniting same are not shown either but are amply described and discussed in those cited references. Piston 56 accommodates shaft 57 by means of bore 58.

Slideable vane motor 30 is presented in more details in the drawings of FIGS. 2, 3 and 4. Wherever applicable and appropriate, the same callout numbers are used for ease of understanding. In FIG. 2, track 35 is the inner surface of external structure 100 in which another seal 38' is added, although of little importance because the pressure differential across it is small. These seals are flexible and pressurized by means of lines 101 and 102. Another configuration and construction of that slidable vane motor is shown in FIG. 3 where the positions of the guiding surfaces for the vanes and of the vane edge track are inverted from those shown in FIG. 2. Corresponding parts are given the same callout numbers but with a ' index, for easy recognition. Guiding slots 33' are located in a structure ridge 103 which are part of external structure 100'. Both air and gas flow into and from, and are channelled through the internal volume of rotating central body 34' in the space contained between broken lines 104 and 105. These flows are ducted from stage and also from and to the atmosphere through channels located in the hollow portion of common shaft 31 (details not shown here) at the shaft end not used for power delivery. In FIG. 4, both the compression and the expansion chambers are elongated to cover a full revolution of the rotating body. The same approach can be used for the motor configuration of FIG. 3, but is not illustrated here, as being self-explanatory. If rotor 34 turns clockwise (solid lines), chamber 37 is expanding combusted gas. If rotor 34 turns counterclockwise (phantom lines), chamber 36 is compressing air. Because common shaft 31 can only rotate in one single direction, one set of rotor/vanes can only be used for one function exclusively. Another set mounted contiguously and symmetrically with respect to a vertical axis passing through shaft 31 centerline is used to perform the other function. This arrangement provides for a more gradual pressure change and a lower pressure differential across each vane which is of interest as discussed in the next section.

As the free edge of a vane passes by the ports cut in track 35 surface, the vane edge will be either inadequately or irregularly supported unless steps are taken to insure that its support is adequate across the width of the track surface. This is provided by a plurality of narrow slits cut in structure 100 as shown in FIG. 5 where slits 107 are evenly distributed between sides 106 and 108 of track 35. Narrow lands 109 located in-between and separating these slits provide the intermediate support points needed along the vane free edge. Such port construction also provides a gradually changing location of these support points so as to eliminate localized wear of the vane free edge. Such a port construction is typical of all ports, admission and exhaust, compression and expansion alike, whether one or two functions are used for each stage, one stage corresponding to one set of rotorvane assembly which assumes either a single or a dual function.

FIG. 6 represents a vane of the motor of FIG. 2 showing details of the air cushions and of their high pressure air supplying system. Each vane 32 slides freely along the confining and guiding surfaces 110 and 111 defining slot 33 and that cooperate respectively with sliding faces 112 and 113 of vane 32. All four surfaces are equipped with a shallow cavity—114 and 115 on the slot surfaces and 116 and 117 oon the vane faces respectively. Locations and sizes of these cavities are such that: (1) they never interfere (face any portion thereof), and (2) they never become uncovered during the vane travel. These four cavities extend the length (or depth) of the vane, except for a narrow enclosing wall as shown in FIG. 10 which presents a typical plan view of such cavity (e.g. 116 or 114) as viewed looking into the cavity. Each cavity is supplied with high pressure air by means of ducts such as 119 through a fixed size restricting orifice such as 120. Each vane thus becomes laterally supported on each face by two pressurized air cushions or pads, each pair of pads opposing the facing pair.

In order to render air pressure variations in a pad independent of the radial location of a vane along its slot, air escape goove such as 121 are located on the slot guiding surfaces and vented to return ducts such as 122 which vent into either a compression or expansion chamber. Similar air escape grooves may be provided on the vane faces but are not shown as being easily understood by a reader familiar with the art. As is explained later, each vane is thus continuously and constantly positioned between two sets of air pads at locations placed and maintained as far apart radially as possible, for any and all radial positions of the vane. Air supply to pads 116 and 117 is described later.

The vanes must constantly be urged to extend out radially so as to insure contact of their free edges with track surface 35. In the case of FIG. 6, the urging is accomplished by two cooperating actions: (1) the centrifugal force exerted on the vane and caused by its rotation, and (2) the back pressure created in space 123 of slot 33 by means now to be described. When the vane is very far inside its slot, the air escaping from air pads 116 and 117 must be given an easy path to travel so as not to generate back pressures high enough to affect adversely the pad operations. To that effect, space 123 is vented to vent ducts 122 but in a way such that a limited amount of back pressure is created which is function of the pressure then existing in the chamber into which the final venting step takes place. The adjustment of the back pressure is achieved by means of fixed size restricting orifices such as 124. The pressure force radially applied on the vane is the product of the vane longitudinal cross-sectional area by the difference in the pressures existing in space 123 and the venting chamber, thus varying according to the pressure changes in the chamber itself.

For various reasons soon to become obvious, high pressure air must be introduced inside the vanes, although discreetly so as to avoid structural damage to the vane. To that effect, a plurality of elongated holes 125 extend almost the radial length of each vane. Each hole 125 is supplied in high pressure air by a feed tube 126 connected by means of a flexible bellows 127 to a main high pressure air supply duct 128 located inside shaft 31. Holes 125 are also connected to one another within the vane by blind hole or duct 129 which extends almost the width of the vane. Tubes 126 pass through cooperating holes 130 which slide along the external surface of tube 126, the narrow passage thus created is not sealed but is small and calibrated to constitute a fixed size restricting orifice which also supplies high pressure air to space 123. The details of Figure 18 indicate how the free ends of tubes 126 are guided by stubby fins 131 inside hole 125 without causing appreciable pressure drops as the vane moves in and out within its slot.

The air pressure existing in the space between hole 125 wall and tube 126 is thus substantially equal to the supply pressure of the high pressure air. Another small duct connects the bottom ends of holes 125 in each vane (not shown) and the small duct is connected to both air pads 116 and 117 by fixed size restricting orifices such as 132, which assures the air supply of the vane air pads. The fact that the supply pressure of these pads is slightly lower than that of pads 114 and 115 is more than compensated by the other fact that the former are generally farther away from escape groove 121.

The free end edge of the vane is not allowed to drag on track surface 35, as this would create friction, hence wear and unwanted heat. The friction is prevented by air pads playing the role of tilting casters (or hinges) that orient themselves according to the slant which track surface 35 may present with respect to the vane radial plane of symmetry. To that effect, the caster body is rotatable about shaft 134 which is connected along its length by web 135 to the end of vane 32. This assembly operates like an open-sided hinge having a limited oscillating range, enough to accomodate the total amount of tilting which is dictated by curvature variations of track 35. The body of caster 133 provides a linear socket-like cavity which partially encircles shaft 134. Details of the caster, its articulation and its high pressure air supply are shown in FIG. 8 and are common to the vane constructions of FIGS. 6 and 7. FIG. 7 vane construction is described first, as it is very similar to that of FIG. 6.

Again, for the sake of simplicity and ease of understanding, because of the extreme degree of commonality between the two constructions, callout numbers are the same whenever appropriate, but with a ′ indexing attached. The similar features thereof and their attributes are not described again, as the reader familiar with the art will undoubtably be able to determine both the nature and the function of these features and parts. The main difference resides in the fixed and rotating parts. FIG. 7 is a detail drawing of FIG. 3. External structure 100′ is fixed and central body 34′ rotates. However, track surface 35′ is now the outer surface of central body 34′. The high pressure air supply can be brought externally by pipes such as 128′. The vanes do not rotate and only slide radially. No centrifugal force is generated and back pressure is absolutely needed to push vane 32′ inwardly to establish contact with track surface 35′. Also, in this case, the curvature of track 35′ does not revert itself as does the curvature of track 35 in the case of FIG. 2. Such curvature reversal requires a greater range of tilting ability of the caster-type hinge.

In both construction cases of FIG. 6 and FIG. 7, compliance of tube 126 and of its bellows to small tansverse displacements of the vane must be such that very small loads result on guiding fins 131, hole surface 130 and tube 126 wall. Otherwise, excessive stresses, wear and/or friction might result, all being undesirable. Because the extent of such displacements is limited to a few thousandths of an inch as is discussed in the next section, it is believed that the condition just described can easily be satisfied. The variable dimensions $\lambda'$ and $\lambda''$ represent the leverages which contribute to the creation of the two tilting moments which are exerted on the vane: (1) one caused by the pressure difference which exists across the vane, and (2) the other which is restoring reacting moment provided by the air cushions. This aspect is discussed in detail in the next section.

The drawing of FIG. 8 represents a cross-section of a vane/socket/caster assembly in more detail. The caster or hinge body 133 comprises six basic elements: linear socket 140, two symmetrically positioned shaped walls 141 and 142 bent inwardly at one end to form lips 143 and 144 respectively, two end walls 145 (FIG. 19) having holes such as 146 acting as restricting orifices, and a plurality of reinforcing ribs such as 147 for giving rigidity to the caster assembly. In cooperation with separation flange wall 150, end wall 145 forms a cavity 148 in which pressurized air is trapped between holes 146 and escape gap 149. Such cavity constitutes another air cushion, one at each end of the caster assembly. Socket 140 is free to slide along shaft 134 and is constantly pushed outwardly by the air pressure in space 136 which forms another air cushion, thus being automatically kept centered by means of the two opposing end air pads 148.

High pressure air vents from hole 125 into duct 129, then in hole 151 housing a fixed size restricint orifice 152, then into duct 153 in shaft 134, from which it flows into air cushion 136 through duct 154, then through calibrated hole 155 into the caster inner space. At this juncture, pressurized air may flow in three directions, in air cushion spaces 148—one at each end of caster 133, through the gap formed between the edges of lips 143 and 144, and finally escape through the two gaps such as 156 formed between each caster lip and track surface 35 to vent into a compression or expansion chamber. The various fixed size resticting orifices and/or calibrated holes mounted in a series and/or parallel, as the case may be, have effective discharge areas adjusted so as to maintain pressure levels in the various cavities cited such that each air cushion is enabled to operate in the manner discussed in the next section. The dimensioning and shaping of shaft 134, socket 140, space 136 and web 135 are such that, for any and all tilt positions forced on the caster by track 35: (1) air tightness is always maintained between shaft 134 and the two socket free edges, (2) caster 133 is always free to tilt a small extra amount in excess of its nominal angular rotation beyond the normal tilt limits required of the caster, (3) the flow of pressurized air is never hindered at any tilt position of the caster, and (4) friction in the hinge articulation is always kept minimal. The shapes of lips 143 and 144 are such that the functioning of the air escape gaps 156 is never substantially affected by any change in and/or reversal of track 35 surface contour curvature.

The other feature shared by both vane constructions is that which maintains the vanes centered between their confining flanges on each side thereof. FIG. 9 illustrates the detail of the air cushion located on each side of a vane 32. Hole 125 (or duct 129) brings high pressure air to hole 158 that houses restricting orifice 159 which controls the air flow into cavity 160 to form an air cushion. Air escapes from air pad 160 through gap $\epsilon$ defined by the surface of flange wall 150 and lands such as 157. Air pad cavity 160 extends the length of the vane as shown by a dotted line contour (160) shown in FIG. 8. Each side of vane 32 is similarly provided. The two opposing air cushions 160 thus cooperate to keep vanes 32 centered between their two confiningflanges. Vanes 32 are free to slide laterally unhindered the full length of their respective slots until contacting a flange.

FIGS. 11 and 12 are almost identical, except for the direction of the curvature of the seal. The same callout numbers are used in both drawings, but are given a ′ index in FIG. 12. FIG. 11 depicts a flexible complying seal body 170 mounted on external structure 100. The seal cross-section is constant along its full length which extends from one flange surface to the next so as to provide sealing along the full width of a vane. The central seal portion 171 is more rigid than the two wing 172 parts. These terminate by a bead-like section 173 which is clamped into external structure 100. Curved leaf spring 174 secured in cavity 175 by walls 176 insures that some pressure is always exerted on the seal. High pressure air is introduced through hole 177 into cavity 175 to insure that during engine operation the seal free surface always contacts the outer surface of rotor 34. The area of the surface contact has a width which always remains appreciably larger than the width of slots 33.

The description of the seal configuration of FIG. 12 is identical, except for the seal curvature. The latter shows a thicker section for the rigid portion of the seal. Although not intended by design, the proportions indicated for that seal are undoubltedly more desireable, as is discussed in the next section. In order to limit and regulate the back pressure applied on the seal, a restricting orifice 178 may be installed in hole 177′ if some air is allowed to escape at the ends of the seal in a controlled manner. As is explained in the next section, such seals may be dispensed with under certain circumstances and conditions related to manufacturing tolerances and part thermal expansion.

Two other types of components of the motor move with respect to the fixed structure: (1) the common shaft, and (2) the rotor. The same principle of air cushion support can be applied to both. FIGS. 13 and 14 present drawings of such constructions. Shaft 31 is centered between and by four air cushions 180, 181, 182 and 183 cross-sectioned diagrammatically in FIG. 13. They are formed by the surfaces of shaft 31, wall 185 of flange 150 and separation partitions such as 184. Each space thus defined receiveshigh pressure air by means of ducts such as 186 housing a restricting orifice 187 of fixed size. The gap between the ends of partitions 184 and shaft 31 surface constitutes a variable size restricting orifice mounted in series with orifice 187. The air passage area offered by such gap varies according to the degree of centering of shaft 31 with respect to circle 188 which represents the contour of the land walls which confine the air pads at each one of their two ends, the gap discharge area being one quarter of the $\pi d. \epsilon'$ for each end if d is the diameter of shaft 31, $\epsilon'$ is the gap and it is assumed that the discharge from one cushion into the next is negligible under most operating conditions.

FIG. 14 shows a more detailed partial elevation sectional view of one air cushion 180 formed between shaft 31 surface, two lands such as 188 and part of one half of the journal structure 189 which is tightly encased in a cooperating bore in supporting flange 150. High pressure air is supplied by duct 186 through restricting orifice 187 as earlier described. The air escaping under lands 188 is collected in annular space 190 to be ducted by means of duct 191 to collecting duct 192 housed inside shaft 31. Journal structure 189 is divided into two halves to permit assembly of flanges 150 and rotors 34 on and over splines 193 which connect shaft 31 and rotors 34 together.

On both sides of flange 150, if flange 150 is located between two contiguous rotors, or on only one side in the case of an end flange, ducts such as 194 house a fixed size restricting orifice 195 and connect duct 186 with air cushions such as 196 and 198 located on adjacent sides of rotors 34″ and 34 respectively. Each rotor is thus sandwiched between two opposing air cushions. In FIG. 6 phantom lines 196 and 197 indicate the outline of the contours of such pads which are shaped so as not to interfere with slots 33. Air escape gaps such as E″ enable the air to flow out of the air pads and conrol the axial position of the rotors with respect to their constraining and supporting flanges.

In a construction configuration where high pressure air must be ducted into rotor 34 body, an air channelling shown in FIG. 6 in phantom lines may also be used. Either one or two ducts 200 connect main supply duct 128 inside shaft 31 to duct 201 which feeds the rotor side air cushions. If one centrally located duct 200 is used in the rotor, each duct 201 going to its own air pad contains a fixed size restricting orifice. If two ducts 200 are used for each rotor, the fixed size restricting orifice controlling each individual air cushion may be located in duct 200, such as 202. The reader familiar with the art will readily understand how the designer may arrange such ducting for conformance to design constraints which may vary between vane motor configurations.

The operation of opposing air cushions used for centering a moving part is fully discussed in the next section. The schematic diagram of FIG. 16 and the corresponding graph curve shown in FIG. 17 are then used to explain the principle of such operation. They need not be described in detail now. Suffices it to say that the fixed size restricting orifice is obvious and the variable size restricting orifice of area $A_2$ represents schematically an air escape gap such as $\epsilon$ previously mentioned. Piston p shown sliding inside cylinder C represents the moving part subjected to force F which is developed by an air cushion in which pressure $P_i$ is created by the variable size orifice. The variations of $P_i$ as a function of the area ratio between the two orifices causes the variations of $P_i$ as illustrated by the curve.

It is more than likely that more than one stage must be used either for air compression or for gas expansion, for reasons discussed in detail in the next section. If such is the case, four or more stages may be required. FIG. 15 indicated schematically how such four stages may be stacked up in series, side by side, along common shaft 31. Four rotors such as 34 are restrained between intermediate flanges such as 150 or one intermediate flange and one end flange such as 210 or 212. Spaces such as 211 in intermediate flanges or 213 in end flanges are provided for housing bearings, or in the present case air pad journals. External structures such as 100 are sandwiched between and held by the flanges which constitute the bridging structural elements which interconnect the motor overall structural body to the shaft. Arrows indicate diagrammatically the fluid flow directions between stages. Two air compression stages C1 and C2, and two corresponding gas expansion stages E1 and E2 are shown as an example.

OPERATION AND DISCUSSION

Friction between two surfaces in contact and moving relatively with respect to one another generally results in local heat generation, wear and/or seizing or galling. The process usually causes catastrophic failures if not controlled or prevented from starting. The problem is even more acute when those surfaces are naturally caused to be hot under normal operating conditions. To alleviate such problem, the most commonly used approach consists in introducing an agent between these surfaces and/or intervening behind the surfaces. Lubrication, cooling and/or material selection, and combinations thereof, represent the best known engineering approaches. In the case of the vane motor of the present invention, lubrication and cooling are either difficult to achieve or undesirable. Another solution to the problem consists in preventing the surfaces from coming into intimate contact, using a separating fluid that is compatible with the surrounding media and does not interfere with the surface functions. The oil wedge technique used in journals is well known. Levitation of parts by means of a gaseous cushion is also well known. A combination of similar approaches is used in the present vane motor for preventing adjacent surfaces in relative motion from making contact, while providing the means for generating forces which oppose the nearing of these surfaces and control their closeness.

In the vane motors illustrated in FIGS. 2 and 3, the vanes move relatively to and are in close proximity with the contiguous surfaces of two bodies, one fixed and the other also moving relatively to that fixed body. The purpose of pressurized gaseous cushions is then to isolate: (1) the vane surfaces from the surfaces of the fixed and rotating bodies, and (2) the rotating body surfaces from those of the fixed body; both simultaneously and concurrently. In all instances, the approach is to balance the moving body between two high pressure air cushions operating in opposition. The principle involved needs to be explained only once in general terms because it is common to all air cushion configurations previously described and to be discussed herein.

The schematic sketch of FIG. 16 diagrammically represents the basic mechanism of one air cushion. FIG. 17 graph curve is used to depicts the air pressure variations that provide and control the force exerted by such air cushion, as a function of the closeness of the surfaces to control. Three basic elements must always be present to operate such an air cushion. In FIG. 16, these elements are: (1) a supply of constant high pressure air, (2) a fixed size restricting orifice, and (3) a variable size restricting orifice mounted in series with the former orifice, the size of the latter orifice being caused to vary according to the closeness of the surfaces to control. Air escaping through the variable size orifice mixes with either compressed air or combusted gas, both at a pressure level lower than the high pressure of the air supply. The intermediate pressure $P_i$ existing in the space between the two orifices, applied onto a piston p contained in a cylander C, contributes to the creation of force F. $P_1$ (air supply high pressure) and $P_2$ (exhaust pressure) are assumed to be constant. $P_2$ is also assumed to be applied on the other face of area A of piston C. Force F is thus: $Ax(P_i-P_2)$ and has become function of the variable size of the second orifice, hence of the degree of proximity of the two surfaces which form a narrow gap through which the air escapes. FIG. 17 curve shows how $P_i$ varies between $P_1$ and $P_2$ according to the effective area of the variable size orifice, by means of the area ratio $A_1/A_2$ used as a non-dimensional parameter that describes the relative position of the two subject surfaces.

$A_1$ is constant, $A_2$ can vary by nature from 0 to $\infty$. The ratio of these two areas may thus also vary from 0 to $\infty$. When $A_2$ is 0 the ratio is $\infty$ and $P_i=P_1$, when $A_2$ is very large the ratio is almost 0 and $P_i \cong P_2$. The mid-section of the curve is almost linear and of interest in the present application, between pressure levels P' and P'' corresponding respectively to area ratios representing value A' and A'' of the variable size orifice. It is assumed in the following that sonic velocity is never reached in either orifices during normal operation. Practically, if $P_1/P_2$ remains below 2, such a condition is always met. One may visualize another duct D' mounted symmetrically to duct D with respect to piston p in which a pressure $P_i'$ is caused to exist, by means of a similar arrangement, and thereby formulate a construction in which piston p has become the component being balanced between two opposing air cushions.

If quasi constant force F′ exerted on piston p is caused to oppose F, piston p then can be balanced between F and F′ and reach a position for which F=F′. In such case, the position of piston p is determined by the value of $A_2$. If an adequate feedback link is created between the piston position and $A_2$ values, piston p is self-positioning. That feature is also of use herein.

The operation of a sliding vane motor is simple and is fully described in my previously referenced U.S. Patents. Its use and operation in conjunction with a free piston combustion member need no further discussion. FIG. 1 indicates that compressor 60 driven by the motor increases the pressure level of air already compressed by the compression member of the motor by a factor of about 2 ($P_1$). The compressor high pressure air output is filtered and the pressure level $P_1$ is kept constant. Clean high pressure air is thus made available to the motor, and the free piston combustor, for use in their air cushions—also referred to as pads and or journals as the construction warrants. Two basic modes of operating sliding vanes are discussed and two basic arrangements of air compression and gas expansion stages are investigated herein. In all four possible resulting combinations thereof, air cushion applications are adapted to fit a specific combination construction.

Basically, the vanes may be mounted in the central body which rotated—though it could be fixed while the outer structure is caused to rotate, or in the outer structural body which is fixed. In the first case (FIG. 2), the vanes rotate with the rotor and are forced outwardly by a combination of centrifugal forces and possibly pressure forces pushing the vanes out of their housings or guiding slots in the rotor. The free edge of the vane rests against the inner surface of the external structural ring which thus forms and acts as a restraining track. In that restraining process, the track imposes a radial sliding motion on the vanes. This radial sliding motion and the shape given to the track cooperate to make the spaces between adjacent vanes increase or decrease in volume, as the rotor rotates: hence the compression or expansion actions (or functions) provided by the motor.

These two functions may be provided during one revolution of the rotor (FIG. 2) or a full rotor revolution may be utilized by each function (FIG. 4). In either case, several stages for air compression and combusted gas expansion may be assembled as shown in FIG. 15, so as to build up the level of the compression (and expansion) ratio that the motor may deliver. The necessity of staging is discussed briefly later on. In either instance, the vane operates in the same fashion but is subjected to a more gradual and smoother radial motion in the arrangement shown in FIG. 4. This difference is operation of the vane is very important because sudden and rapid variations in the magnitude and direction of the forces acting on the vanes should be avoided.

FIG. 3 illustrates a motor construction in which both functions are performed in one stage, but where the vanes slides in guiding slots located in the fixed external structure. The vanes are subjected only to pressure, inertia and friction created forces, but not to centrifugal forces. The rotating outer surface of the rotor constitutes the track against which the vane free edge abutts. In all cases a stage consists of one rotor, one set of sliding vanes and one external structure. The stage assembly is mounted on a shaft common to all stages and each stage is separated from the next by intermediate flange walls. At both ends of the shaft, one end flange supports the corresponding shaft end. All vanes are thus contained within a space limited by surfaces with which five of the six faces of each vane could be in continuous physical contact: (1) two side faces, each restrained by a flange, (2) two sliding faces, each guided by one slot wall, and (3) one free edge (not flat) pushing against its track surface. Both types of sliding vanes, rotating and non-rotating, present similar problems regarding friction. The design solutions are basically identical in both cases. The distinctive differences between the two are pointed out and discussed first.

A comparison between the configurations of FIGS. 6 and 7 shows that the prime difference results from the vane location, in a rotating body (FIG. 6) or in a fixed body (FIG. 7). This means that the high pressure air that must be brought inside the vane needs be ducted quite differently: through the common shaft (FIG. 6) and externally (FIG. 7). External ducting is straight-forward and FIG. 6 design is used for discussion purpose. The other minor difference results from the shape of the track surface which theoretically affects the shape of the hinged air pad located on the vane free edge. This is reviewed later. Other features common to both illustrations will be obvious to the reader familiar with the art and need no elaboration. The construction of FIG. 6 is discussed first in detail, as typical.

In all instances, a vane is subjected to a moment created by the difference between the two pressures applied on the portions of its faces that are positioned externally to the guiding slots. This pressure differential applied on the exposed face area generates a force exerted at the center of the cantilevered vane portion. The vane is supported in its guiding slot at two points located at: (1) the end of the vane guided portion (a), and (2) the outer corner of one guiding slot wall (b). The distances a−b and and X determine the value of that moment at any time, it can be expressed by either $\phi \cdot X/2$ or $\phi' \cdot (L-X)$, where L is the vane length, $\phi$ is the resultant of the forces generated by the pressure difference across the vane and $\phi'$ is the force reacting on the vane at points such as a or b and exerted by the slot wall corners to counteract the pressure-differential moment. At any and all times, $\phi \cdot X/2 = \phi' \cdot (L-X)$. Thus $\phi' = \phi \cdot X/2(L-X)$ (1) for any vane position. $\phi$ is equal to the product $X \cdot W \cdot \Delta P$, again at any and all times, if W is the vane width. Fortunately, generally $\Delta P$ is maximum when X is minimum—vane almost fully retracted. Vice versa, $\Delta P$ is minimum whenever X is maximum—vane extended to its maximum travel out of its slot. As a matter of fact, the curvature of the track can be shaped in such a manner that, theoretically, $\phi'$ remains constant during the performance of either air compression or gas expansion functions. Assuming line contacts only between the vane and slot wall, the amount of friction thus created between the vane faces and their guiding walls could be calculated very simply. "Whatever-it-is" is immaterial because it is one of the drawbacks which the present invention disposes of entirely.

Assuming that two air pads (cushions) are located on each opposing pair of vane face and slot wall as shown in FIGS. 6 and 7, the concerted action of one pair of air pads such as 115 and 116 (or 114 and 117, as the case may be) creates a reacting moment $\Psi \cdot \lambda'$ which is balancing the pressure-differential moment $\Delta P \cdot (\lambda''/2) \cdot X \cdot W$. $\lambda''$ and $\lambda'$ are indicated in FIG. 7. For the sake of simplification, it can be assumed that, again, this moment remains constant as the rotor rotates. Then $\Psi\cdot\lambda'=X\cdot W\cdot\lambda''\cdot\Delta P/2$ (2) as a first approximation. Force $\Psi$ is generated by $(P_i-P_2)\cdot w\cdot l$ if w and l are respectively the width and length of an air pad as depicted in FIG. 10. It can be assumed that all these air pads have the same dimensions. For identical values of L and X, the value of $\lambda'$ must be smaller than distance ab previously mentioned. However, the "contact-equivalent" is not a line any longer, but an area (wl) on which pressure-differential $(P_i-P_2)$ is being applied, assuming that $P_2$ is the pressure level at which the air escapes from the air pads and which exists elsewhere around the vane. Such approximation is quite conservative, thus safe, and realistic enough as will become evident later on.

Neglecting extraneous forces such as those caused by inertia and the like, one can relate pressure $P_i$ and $\Delta P$—function of $P_2$, to vane and air pad basic dimensions and/or proportions. This can easily be done with the following simplifying assumptions being made: (1) the worst case of vane loading occurs when the vane is fully extended, (2) the value of $\Delta P/P_2$ is a constant, (3) w and l characterizing the pad can be expressed as fixed ratios of the vane length and width respectively, and (4) the total variation $\Delta P_i$ required to keep the vane balanced is about half of $(P_1-P_2)$. It was earlier assumed that $P_1=2P_2$ and of course $P_i=(P_1+P_2)/2$ nominally when the vane is positioned half-way between its slot guiding walls. If Y is the distance between the centerlines of two adjacent air pads, one on the vane and the other on the slot wall, the two balancing moments exerted on the vane may now be expressed as a function of identifiable parameters: one created by $\Delta P$ acting on the extended portion of the vane and the other being provided by the differential forces applied by both pairs of cooperating air pads acting on both faces of the vane. Each differential force is equal to $\Delta P_i\cdot w\cdot l$ or $w\cdot l\cdot P_2/2$ and creates a moment $w\cdot l\cdot P_2\cdot Y/2$. The opposing moment of equal aboslute value is $W\cdot X\cdot\Delta P\cdot X/2$ (3).

$\Delta P$ must now be expressed as a function of known parameters, for instance: $P_2$, the motor compression ratio r, the number of stages m and the number of vanes (or intervane spaces) n per stage and function (compression or expansion). Earlier it was mentioned that $\Delta P$ varies approximately as the inverse ratio of X/L in a given stage, but it also varies directly with $P_2$. If $P_a$ is the ambient atmospheric pressure, $\Delta P$ is proportional to the product of $(P_2/P_a)^{(1-mn)/mn}$, which can be called R, provisionally, by $P_2$. Of course, $P_2/P_a=r$, as a first approximation. Except for a proportionality constant, $\Delta P$ can them be written as $R\cdot P_2$. Replacing $\Delta P$ by its new value in equation (3) and balancing the moments previously identified yields: $w\cdot l\cdot Y\cdot P_2/2=W\cdot X\cdot R\cdot P_2\cdot X/2$ or finally, after eliminating $P_2$, $w\cdot l\cdot Y=R\cdot W\cdot X^2$ (4).

w and l can be expressed as a function of L and W as earlier mentioned. Examining FIGS. 6, 7, and 10 reveals that l could be approximated as 0.8 W and that w can be related to L as follows: $L=X+Y+(1+k)\cdot w$, if k represents a design proportionality factor which incorporates the extra length of vane required to accommodate the space needed for collecting grooves such as 121, land widths and some minimum amount of pad separation distance when a vane becomes fully extended. A value of 3 for K seems reasonable. With such assumptions, equation (4) may be rewritten as $0.8\ Y\cdot(L-X-Y)=4\ R\cdot X^2$ after simplification and term rearranging, using L as unity: $Y^2-(1-X)\cdot Y+5\ R\cdot X^2=0$ (5). Solving for Y as a function of X and R yields:

$$Y=(1-X)/2\pm[(1-X)^2-20R\cdot X^2]^{\frac{1}{2}}/2 \quad (6)$$

Realistically, X can be as large as half of L when a significant value of $\Delta P$ is applied onto the free portion of the vane. Eliminating the double root condition of equation (5) is of interest. This means that $(1-X)^2=20R\cdot X^2$ (7), where $X=\frac{1}{2}$ and R is equal to $r^{(1-mn)/mn}$ (8) as earlier indicated. A compression ratio r of 10/1 is realistic. mn is the product of the number of stages by the number of intervane spaces per stage. Solving for mn in equations (7) and (8) first yields $1/20=(10)^{(1-mn)/mn}$, then a value for mn smaller than 1. mn is at least equal to 6—two stages and three intervane spaces per stage, meaning that a value of $\frac{1}{2}$ for X is conservative if Y assumed to be half of X of simply equal to $(1-X)/2$. Thus $X=L/2$ and $Y=L/4$ approximately when the vane is in its least well guided position.

The question remains as to what width w of the air pads is then needed. The value of w which is compatible with the assumptions made above and the previous analytical derivation is contained in equation $L=X+Y+(1+k)\cdot w$, with a value of 3 for k having been assumed. Writing $L=1$, $X=\frac{1}{2}$, $Y=\frac{1}{4}$ and $k=3$ yields: $w=1/16$. The width w shown in FIG. 10 is thus L/16, the length l is 0.8 W and the adjacent edges of two contiguous air pads never reach each other, even when the vane reaches its fully extended position. Actually, the calculated value L/16 for is smaller than the design valves depicted in FIGS. 6 and 7. Increasing w means that lower variations of $P_i$ inside the air cushion pads are required and that chances of physical contact being made between the vane and the slot walls are lessened.

Another consideration regarding the vane tilting dynamic behavior hinges on the extent of free tilting motion which the vane is permitted by its guiding slot walls. It is practical to assume that the total amount of side play given to the vane varies between 0.004 and 0.006 inch, leaving a nominal clearance of two to three thousandths of an inch on each side of the vane. This means amplitudes of vane tilting, at the air pad locations and in the fully extended vane case, of ±0.001 inch. Such a value is negligible compared to the vane thickness, the vane travel or any other meaningful dimensions of the motor parts. However, the opening area offered to the high pressure air to flow through is still significant. For each air pad, it is 0.0025 λ, if λ is the perimeter of an air pad. This could be 5 inches or represent an area of 0.0125 sq.in. This corresponds to circular hole of about 1/16 inch diameter. This must also be the approximate size of the fixed restricting orifice located upstream therefrom. Four such orifices are required per vane and 8 to 10 vanes are needed per stage. It is thus easy to understand why the size of all orifices must be kept small in order to minimize the high pressure air servoflow. Also, most of the air pressure drop should occur in the restricting orifices and not along the air channels. The channel diameters should be at least 3 to 4 times larger than that of the fixed size orifice diameter, but not be excessive because of space limitation considerations inside the vane volume.

Vane Tilting Pad:

Another part of the vane of crucial interest, from the friction standpoint, is the vane free edge that drags on the external structure inner surface or track. The friction existing in conventional sliding vane motors is eliminated in the present invention by means of a hinged tilting air pad extending the full length of the vane free edge. It provides a self-adjusting air cushion between the vane edge and the track for any and all tilt positions of that pad, as the latter glides on the track. The drawings of FIGS. 7 and 8 may be used to describe and discuss the operation of the tilting air pad.

High pressure air must be ducted to the pad through the hinge and, incidentally as dicussed later, to the vane side air pads also. Thus, a source of high pressure air located inside the vane body must be provided, as it is practically impossible to form such air pads moving with the vane in any other way. As earlier discussed, the vane tilting and/or lateral motions allowed are practically negligible. Therefore, a flexible airtight sliding air-ducting connection can easily be made between a vane and the body in which it slides. This is done by means of bellows joint 127' and tube 126' which reaches into and is laterally supported by the vane body as the latter slides in and out of its guiding slot. The radial clearance between tube 126' O.D. and bore 130' I.D. is about 0.001 inch in order to minimize both air leakage and friction, and to facilitate mechanical compliance between the two parts that slide relatively to each other. Such clearance represents a very small fraction of the area of a typical fixed size restricting orifice and can be ignored for the time being.

Tubes 126' are guided at their free ends by star-shaped spacers that provide the free portion of the tubes with lateral support and do not interfere with the flow of high pressure air. An arrangement of this type thus ascertains that an ample supply of high pressure air is continuously available inside the vanes and in the following it should bo so considered. FIG. 8 indicates how the air inside bore 125 (or 125') is ducted into three directions: (1) through hole 151 for supplying air to the tilting pad, and (2) through two holes 158 located near each one of the two sliding side faces of the vane, thus in opposition to each other. The latter air channelling is discussed later.

In ducting hole 151, the total air flow is first restricted by fixed size orifice 152. From there it freely reaches crescent-shaped air pad space 136 which plays the role of a partial journal and an air distributor, regardless of the tilt attitude of the pad. From space 136, the air may follow two paths: (1) escape paths along the narrow gaps formed by wall 140 encircling hinge axle 134, and (2) through restricting orifice 155 into tilting pad internal space 147. From that space, the air is free to flow along three channels: (1) the wide opening between the edges of lips 144 and 143, and (2) either one of the two sets of oppositely located holes 146 acting as fixed size restricting orifices. Holes 146 supply air to two end air pads used to keep the tilting pad centered, as the drawing of FIG. 19 indicates for one end air pad 148. The operation of this type of opposing air pads needs no futher elaboration. The hinge articulation around axle 134 is almost frictionless, self cleaning and seize-free. This component needs no further elaboration either.

The operation of the tilting pad may now be elaborated on at length. Firstly, the shapes of walls 141 and 142, and their dimensioning, are such that pad 133 body may fit within the space provided between the two walls 110 and 111 of a guiding slot 33. Secondly, the depth of the slot is larger than the vane full length including the overall tilting pad assembly, earlier referred to as linear (or unidirectional) caster. With such design provisions, the vane free edge can follow track surface 35 even when it comes in quasi contact with its opposing cooperating surface located on the matching associated body (e.g. rotor or fixed external structure, as the case may be), and when sealing must be provided. Therefore, at all times, the tilting air pad is free to conform to its track surface, as is now described and discussed.

Lips 143 and 144 are bent slightly inwardly so that their shapes may conform to and match any curvature, convex or concave, that the track may present. Some place between the lip edge and the knee—the location on the lip closest to the track surface, the gap offered to air for escaping is narrowest, as illustrated in FIG. 8 cross-section of a tilting pad. The lip wall shape is also curved so as to make pad body 133 always assume the position for which the two gaps formed by each lip outer surface and the track surface are approximately equal. It is assumed hereafter that this remains always the case.

The outwardly directed force which urges the vane out of its slot tends to make the lip knees contact the track surface, In so doing, the gaps would become closed and the variable size restricting orifice would stop the air flow. Air pressure between the lip external surfaces and the track increased because the pressure drops through fixed restricting orifices 152 and 155 decrease and the pad body is pushed back. If, for some reason the vane is pulled away from the track, the air pressure between the lip surfaces and the track surface decreases and the forces acting to move the vane out bring the vane back toward the track. Thus it can be seen that the tilting air pad constantly attempts to maintain a well defined distance between lip and track surfaces, without allowing the lip surfaces to make physical contact with the track surface. Such contact may be established temporarily, but not long enough to cause appreciable friction for long enough a period of time to become significant. During all that time, the tilting pad remained centered by means of the end air pads previously discussed.

The drawing of FIG. 9 depicts one of the two side air pads that keep the vane centered between its two constraining flange walls such as 150. The magnitude of the forces soliciting sideway motions of the vane is small compared to other forces acting on the vane. The principle of the balancing action of such pads was earlier discussed and needs no futher elaboration. However, they contribute to causng he vane to be kept floating within an envelope of air cushions as it moves in and out radially, and also rotates about as is the case in the motor construction shown in FIG. 6. Again, the plane of the vane side faces remain very close to the flange wall surface. Gap $\epsilon$ needs only vary between one and a few thousandths of an inch to provide the side forces required to keep the vane centered.

Shaft and Rotor Support:

As shown in FIG. 15 which represents a four-stage sliding vane motor—two stages for air compression and two stages for gas expansion, the four rotor/vane assemblies are contained between and supported by a common shaft and an external structure consisting of flanges separated by ring-like spacing structures. The vanes "float" in a controlled fashion in the annular spaces as the rotors revolve with the shaft to which they are connected by splines 193. End flanges 210 and 212 support shaft 31 by means of conventional bearings such as 213. Between the end flanges, especially if shaft 31 is long (six stages or more), some additional support may be provided by bearings that are constructed so as to facilitate the motor assembling. These special bearings are mounted in the intermediate flange central bores, thus supported by the motor structural body. The splining of the rotors and of the matching portions of the shaft is the identical for all stages . The flange central bore has a diameter larger than the O.D. of the male splines.

The drawings of FIGS. 13 and 14 indicate how these intermediate bearings are constructed and assembled, and operate. The air cushion journal formed by a bearing assembly consists of annular structure 189 which may comprise two or more identical sections having spaces defined by stubby longitudinal walls such as 184 and circular end walls such as 189'. These spaces such as 180 are almost enclosed by a fourth circular surface 188' which is the external cylindrical surface of shaft 31 located between two adjacent splined shaft sections. At least four of such identical spaces are distributed around surface 188'. The radial clearance 188 is about 0.002 inch nominally and sections of structure 189 are forced into the central bore of the flange during the motor assembly. Each section is locked in place by means not shown but well known in the art.

The central hole containing a fixed size restricting orifice 187 is lined up with duct 186 in the flange and connects spaces such as 180 with high pressure air brought to duct 186 by means not shown but well known to the readers. An air cushion is thus formed between surface 188', the flange and the stubby walls. Although only four such pads are shown, more pads may be used, preferably an even number. The air pressure existing in each pad is regulated automatically by the relative areas of two restricting orifices mounted in series: (1) one of fixed size (187), and (2) the other of variable size formed by clearance 188 which varies with the degree of eccentricity of the nominally concentric surfaces 188' and of the circularly-shaped ends of walls 189'. It is obvious that when shaft 31 moves radially in any direction , clearances 188 around one pad located in that direction decrease and that, concomitantly, the clearances characterizing the diametrically opposite pad increase by the same amount. The pressure in the former pad increases and the pressure in the latter pad concomitantly decreases as was earlier explained with the help of FIGS. 16 and 17. Again, a restoring resultant force is created which opposes the radial displacement which caused the resultant force to be created in the first place. The controlling balancing action previously discussed comes into play here again, in the same manner and to the same effect.

When such balancing act takes place, the clearances characterizing those pads located at 90° with the displacement direction are not affected and play no role then. The reader can visualize then how and why surface 188' is constantly and continuously and automatically kept centered with respect to the flange central bore. The side loading of these bearings is never sudden in the case of this type of motor and can never be high either, because the combustion is removed from the motor. Compared with piston engines of similar power ratings, such side loadings are, much lower and of less vibratory nature. The longitudinal loading of shaft 31 is absorbed and resisted by the two conventional end bearings such as 213. If and when shaft 31 is not slender but sturdy and/or short—i.e. when its maximum bending deformations are always small, 0.001 inch or less—intermediate air journals need not be used. However, in any instance, it may be advantageous to construct shaft 31 in separate sections connected by the joints that allow bending while transmitting shaft torque, in ways well known to those readers familiar with the art. Such arrangement will facilitate the assembling of the motor stage by stage, which may prove of interest in some special engine usage applications.

As already understood, the rotor or central body is thus free to slide along its splined joint on shaft 31 between two contiguous restraining flanges. Friction between the rotor faces and the flange wall surfaces on which they rotationaly slide is to be prevented also. In FIG. 14, for the sake if convenience, flange 150 is shown separating two rotors 34 and 34''. For the purpose of the present discussion, rotor end 34'' can be visualized as the opposite end of rotor 34, as is represented in FIG. 15. In such instance, the two shallow cavities 198 and its counterpart 198' (not shown) cut into the two opposite side surfaces of rotor 34 face two separate flanges 150 and 150' (not shown). Clearance $\epsilon''$ between the rotor side faces and the cooperating flange wall surfaces form the variable size restricting orifices that are mounted in series with fixed size restricting orifices such as 195', which again constitutes the position controlling system previously described and discussed. Futher elaboration is no longer of value here, as the reader will easily understand how and why any lateral displacement of the rotor is automatically controlled so as to insure that both clearances $\epsilon''$ remain equal at all times.

The contours of cavities such as 196' are established so as to accommodate the positioning of the sliding vane slots and/or of other cavities requiring locating on the rotor side faces. In the case of a motor construction such as that shown in FIG. 3 in which compressed air and/or combusted gas must be ducted from rotor to rotor, half or more of the rotor side surface may be required for such function . The vanes are then located outside of the rotor and no guiding slots are needed, the air pad contour shapes then are adjusted accordingly.

In FIG. 14, the air escaping from the air journals and/or the rotor side air pads must have a path to follow in order to be evacuated to a location where pressure $P_2$ exists and that may act as a receiving sink. To that effect, annular spaces such as 190 collect this escaping air for channelling backinside shaft 31 by means of duct 192 to such $P_2$ sink. In conclusion, rotors 34 are also floating between their respective restraining flanges, whether or not they house the vanes.

Chamber Sealing and Ports:

Examining the drawings of either FIG. 2 or FIG. 3 reveals that, on either side of the quasi contact points between the rotor and the fixed external structure, the pressures existing in adjacent segments of contiguous chambers are not much different: close to atmospheric for both gas exhaust and air admission, or close to $P_2$ for compressed air outlet and combusted gas admission. The pressure differentials across such points could almost be ignored if the rotor and the external structure formed a line contact, allowing a controlled clearance of a few thousandths of an inch only for any and all engine operating conditions. Because such a dimensionally controllable construction may not be feasible and because this reasoning does not apply to the motor construction of FIG. 4, the sealing of that narrow gap is considered herein. A preferred type of sliding seal is presented in details in FIGS. 11 and 12, one is mounted on the inner surface track of the external structure pushing onto the outer surface of the rotor, the other is mounted on the outer surface track of the rotor and pushes onto the inner surface of the external structure.

In both cases, the tilting end pads mounted on the vane free edges must pass over the sealing surfaces.

In order to prevent brusque interactions between the tilting pads and the seal walls, any contact between both structures must be rendered as smooth and gradual as possible. To that effect two construction considerations are important: (1) the width of the seal which must be appreciably larger than the thickness of a vane, and (2) the shaping and sizing of the seal side walls and of their supports. These considerations are illustrated in both drawings by indicating how the seal wall thins out as soon as it becomes supported and by phantom lines M, N, M' and N', and cooperating corresponding support contours H, K, H' and K'. In such design, the phatom lines and the corresponding support outline contours are no longer "in-line" so-to-speak, but are off-set by at least as much as the seal thickness at that point. This indicates how the sharp bump caused by a vane approach to the seal, which otherwise would have happened, can be eliminated.

The sealing pressure exerted by the seal on the surface on which it slides should not be mechanically induced, but made automatically self-adjustable. This can be easily achieved by applying a controllable air pressure on the back face of the seal flexible structure. This pressure needs be only slightly higher than the highest pressure existing on either side of the seal, that of compressed air or combusted gas as the case may be. The seal external surface is thus kept in permanent contact with the surface onto which it slides, but is allowed to comply to temporary deformations that are required by variations in the clearance gap amount and/or the passage of a vane thereby.

The seal wall section thickening past the regions where great flexibility is needed is provided so as to avoid both sagging and bulging of the seal wall. Also, this provid es additional seal material to compensate for gradual wear of the seal and minimize any ensuing weakening of the seal structure. A preloading of the seal wall may be useful and it is performed by spring 174 that extends almost the full length of the seal. The spring is prevented from contacting either flange surface by unshown means, especially in the case where the seal is mounted on the rotor. Typically, the seal cross-section is constant along its full length If the seal does not move (case of FIG. 2), the seal is a few thousandths of an inch longer than the distance separating the facing surfaces of two contiguous flanges and becomes slightly compressed lengthwise upon motor assembling. For all practical purpose space 175 may be considered closed. In the case of FIG. 3, a clearance equal to $\epsilon''$ must be provided to prevent the seal ends from dragging against the flange surfaces, space 175' is not closed and air is allowed to flow out of space 175'. For these reasons, the control of the seal back pressures existing in those spaces differs between the two types of constructions.

In the construction of FIG. 11, the back pressure can be applied by means of duct 177 connected to a regulated pressure air supply. That pressure is adjusted to the level necessary to insure that the seal contacts the rotor outer cylindrical surface, and maintained at that level when the engine is operating. In the construction of FIG. 12, high pressure air is introduced by means of duct 177' through fixed size restricting orifice 178. Because the sum of the end gap areas at the flange interfaces is not variable in this instance, the size of orifice 178 may be adjusted for a given size of end gaps—which remains constant during the motor lifetime—so as to provide a set pressure inside space 175'. The pressure level of the high pressure air used for the air pads-throughout the motor then insures a relatively constant air pressure in space 175', as needed.

The construction and operation of such seals, as just described and discussed, are somewhat different from those of most commonly known seal types. Two other significant differences should now be quickly mentioned: (1) they operate at relatively elevated temperatures with no lubrication and/or no cooling but need not provide a gastlight sealing, and (2) they must keep their characteristics during the life of the motor and not wear appreciably during that time while preserving their flexiblity. The temperatures involves could as high as 2,000° F., the displacements expected of the seal thick wall are of the order of 0.005 inch and that wall is always supported on both faces. A suitable material, its construction and fabrication are now briefly described and discussed. No organic chemicals have yet been developed that can withstand the temperature previously mentioned. Only ceramics or carbon/graphite types of materials can operate in such a hot environment. Ceramics lack the flexibility required. Carbon and graphite based materials do not. Further, graphite for instance has good lubricating qualities. Therefore, the material selected has such application is graphite reinforced with high strength carbon fibers. The fabrication techniques used for making parts with these two basic components is now state-of-the-art.

Seals having the cross-sections shown in FIGS. 11 and 12 can be fabricated as follows. High strength carbon fibers, or cloth made with such fibers, are laid on the bias so as to crisscross each other in adjacent layers, in a manner such that each fiber makes a 45° angle with the seal longitudinal axis. These fibers are laid in a mold having the shape and dimensions of the final part. The mat thus formed is impregnated with a resin that can be carbonized and then graphitized with heat, under pressure. The material is reimpregnated with resin and heated again. This process is repeated until the composite thus formed reaches the density level which indicates that very little additional strength could be gained by further processing. The seal body is then ready to be trimmed to final dimensions. The material is very strong, flexible, heat resistant and has low friction. The strong carbon fibers come in direct contact with the rotor outer surface in a manner such that those fibers seem laid onto that surface, which makes them unwearable. The graphite matrix provides the dry lubricant which facilitates the task of these fibers. The seal is rigid with respect to its longitudinal axis, but the thin wings connecting the locking beads to the thick wall section provide enough flexibility for accommodating the few thousandths of an inch deformation which is expected of them.

The seals never have to pass over the inlet and outlet ports shown in FIG. 5, only the tilting pad lips. When this occurs, the pressure existing between the lips and the track surface decreases suddenly and the lip knees contact the track for a very short time. It is believed that no damage to the track locally or to the lips will result. The ports are constructed and configured so as to maximize the support given to the lips and to minimize localized continuous friction. Narrow bars of the carbon/graphite composite material described above may be inserted between slits 107 into webs 109 to provide local dry lubrication.

Vane Dynamics and Motor Design Optimization:

Sliding vane engines provide volumetric compression and expansion, like piston engines do, but have limitations which are caused by the lack of positive actuation of the vanes. It is impractical to mechanically and forcibly urge the vane free edges against the track with which they are supposed to keep contact. The use of springs is unrealistic. The effectiveness of the use of centrifugal forces very much depends on the motor rpm's, only if the vanes rotate. Back pressure applied on the back end of a vane seems to be the most reliable approach to urging the vanes to establish and maintain that contact. This is especially true for the motor construction of FIG. 3. For the motor constructions of FIGS. 2 and 4, centrifugal force may be used as an adjunct urge at higher motor rpm regimes.

In both cases of FIGS. 6 and 7, the air escaping from air pads 116 and 117 (or 116' and 117') into the space at the bottom of the guiding slot must be channelled back to a region at lower pressure. That region is the chamber segment located behind the back face of a compression vane and ahead of the front face of a gas expansion vane. Such ideal situation exists only in a construction where the vanes of a stage performs only one and the same function—case of FIG. 4 and not of FIG. 2. In any event, space 123 (or 123') is vented to a chamber 36 at an intermediate pressure between $P_a P_2$, that was earlier conservatively assumed to be constant and equal to $P_2$ for simplicity sake. Whatever it is, it is equal to (within the value $\Delta P$) the value of the effective pressure which is applied on the free edge of the vane. Therefore, if it were not for restricting orifice 124 (or 124') the pressures applied radially on the vane would have approximately the same value, the vane is radially balanced, except for the effects of centrifugal forces—if any as applicable. It is assumed hereinafter that the air flow leaking around tube 126 (or 126') can be ignored, being so small as to be negligible.

Air may escape out of pads 116 and 117 (or 116' and 117') by means of two main paths: (1) toward collecting grooves 121 (121'), and (2) toward space 123 (123'). The collecting grooves are connected to chamber 36 directly and cause neither flow restriction nor significant pressure drop. Escaping air would normally preferentially flow toward the air collecting grooves, but the path length between the air pads and these grooves is much longer, at least during most of the vane travel, than the path passing by the lands near the back end of the vane. Thus the air flow into back space 123 (123') is comaratively larger when the vane is retracted which means a comparative increase of back pressure then. Although the size of restricting orifice 124 (124') could be made dependent upon the vane radial position, such an additional complication does not appear justified. The value of $\Delta P$ was earlier assumed to vary as $P_2$ and is higher if the vane is retracted. Therefore, the fixed size area of orifice 124 is established for a vane position half-way between the fully extended and fully retracted positions, ignoring the influence of centrifugal forces.

In the radial direction, the vane is thus solicited by two opposing forces: (1) the back pressure just defined, and (2) the pressure existing between the tilting pad lips and the track surface. Because of the large difference in the space volumes involved, 123 (or 123') compared to 147 (FIG. 8), any vane position response to tilting pad radial solicitations is much faster and of a much larger magnitude (much higher gain) than any variation of the back pressure in response to such vane radial position resulting from such tilting pad action. Therefore, it is believed that radial chattering of the vanes cannot be induced by a feedback cross-coupling of the responses of the tilting pad and of space 123 (or 123'). In order to prevent vane chattering from being induced by the tilting pad itself, it may be advantageous to further speed up the response of pad 133 structure by decreasing the internal volume of space 147. This can easily be done by closing the gaps between the lip edges and quasi cylindrical hinge female structure 140, leaving hole 155 open, and ducting air from space 136 directly to holes such as 146 by means of small tubes.

Another possible vane vibration mode corresponds to the oscillating motion which a vane is permitted laterally between the two walls of its guiding slot. Such motion is resisted by a set of two diagonally opposed air pads such as 115 and 116 for instance. The chattering frequency of a vane in this vibration mode increases as the amount of play or clearance between a vane and the walls of its guiding slot decreases. Again, it is advantageous to make this frequency as high as possible. For that reason, in addition to the previously given reason based on minimizing air servoflow, that clearance should be held down to the minimum dictated by maufacturing considerations. The natural frequencies of the two chattering modes just discussed can be thus set at a level much higher than that of any other exciting vibration frequencies that are generated by the motor rpm's, the number of vanes, the seals and/or the ports and/or combinations thereof.

Although random and/or regular but relatively infrequent exciting forced movements may be imposed on the vanes, during the motor operation, it is unlikely that they could create resonance conditions that might sustain either chattering mode of the vane. There are no obvious circumstances and/or normal operating conditions which could entice the vane to oscillate sideways. In conclusion, it is believed that supporting the vane loosely with air pads in all three orthogonal directions should not create vane operating conditions which could start, much less sustain, lasting chattering vibrations.

The motor design optimization depends mainly on the amount of air compression and/or gas expansion, expressed as a ratio, which can be performed by each vane constantly and consistently. The magnitude of such ratio, as applicable to the vane motor of the present invention, is determined by two conditions: (1) the value of $\Delta P/P_2'$ that a vane will withstand without losing contact with its track surface, and (2) the number of vanes which can be located in one stage. Another interrelated condition results from the staging arrangement selected for each function and each full revolution of the motor. A discussion of the selection process required to determine the best preferred embodiment of such a vane motor is well beyond the scope of the present disclosure. It is safe to assume that the function ratio—compression or expansion—may vary as the inverse of the number of stages per revolution. It is also evident that motor constructions which dispose of the track "hump" located at the bottom of FIG. 2 between chambers 36 and 37 will facilitate the vane radial motion and minimize any effect that changes in direction of the lateral pressure loadings might have on the vanes.

A discussion regarding the selection of motor construction based on the comparative advantages of rotating vanes versus non-rotating vanes is also beyond the scope of this disclosure. It would depend greatly on the application intended for the engine. In all instances herein described, the vanes are shown emerging from their guiding slots normally to the cylindrical surface of the body in which the slots are cut, such surface forming one portion of the enveloping surfaces of the chambers (36 or 37). The vanes then cannot possibly make contact with the surface of their tracks at right angle. This can be construed as reactions from the track structure and directed at an angle with respect to the vane direction of radial motion. This means that a side component of that reaction urges the vane to tilt in the same direction as do the forces generated by ΔP. This is true for both functions. Interestingly enough, the magnitude of ΔP varies directly as does the side force component and for the same reason: i.e. they are both roughly proportional to the amount of angular deviation that the track surface makes with respect to a plane normal to the vane plane of symmetry. The tilting of the air pad conforming with the track does not affect such relationship.

One design parameter available for affecting the magnitude of the side forces, but available only when and if vanes always perform the same function, is a tilt of the guiding slots, be they housed in a rotor or in the external structure. This is illustrated in FIG. 4 where phantom lines X and Y represent respectively the normals to cylindrical surfaces X′ and Y′. These two lines apply equally to either functions in that figure because the rotor rotation direction of either function is inverse of what it is for the other function. Such a tilt could become a liability when the vane free edges reach portion Z of surface 35 contour. However, it should be remembered that, at that time, the value of ΔP is almost nil.

This tilt angle aspect of van positioning is important in that it enables the vanes—everything else being equal—to operate at higher values of ΔP, hence permits higher ratios to be contemplated per stage for either functions. In any event, the value of ΔP depends also directly on the closeness of the vanes, or the number n of vanes per stage, as earlier mentioned. If n could be infinitely large, ΔP could be infinitely small. This is not practical but can serve as a guide as to the direction to investigate. Comparing the motor construction of FIG. 3 to that of FIG. 2 clearly indicates that the number of vanes per stage can be much larger if they are housed in the external structure. The limiting factor in the case of FIG. 2 is that, near shaft 31, the bottom ends of the guiding slots interfere with one another or the rotor diameter has to be made larger. Such a crowding effect of the vane free edges is impossible in the case of FIG. 3 construction. Because of the design freedom of action provided by a motor equipped with non-rotating outwardly-mounted vanes, only the most limiting motor construction is now discussed with respect to the optimization of m, n, r and ΔP.

It will be assumed that the compression and expansion ratios are identical, thus are referred to as "function ratios", and that the function ratios are equal for each stage, as a first approximation. This is not quite exact for two reasons: (1) combustion always causes or requires a pressure drop between compressed air delivery by the compressor and combusted gas delivery to the gas expander, and (2) with an external combustion engine operating on a DAVID Cycle, combusted gases may be expanded down to ambient atmospheric pressure in order to extract the maximum heat energy out of the combusted gases, which requires a volumetric expansion ratio higher than the compression ratio. For the purpose of the discussion below, the function ratios of each individual stage ($r_s$) are assumed to be equal for a given motor construction. The parameters of interest are related as follows: (1) $r_s = r^{1/m}$ for both functions, (2) $r_s = (1 + \Delta P/P^*)^n$ where P* is the mean pressure between the two pressures existing in the intervane spaces that are adjacent to a given vane and where ΔP is the absolute value of the pressure difference across that vane, and (3) $r = (P_2/P_a)^{1/k}$ where k is the polytropic air/gas constant assumed to be roughly equal to 1.25 for combusted gas and 1.3 for air. For the present purpose, because of the air servoflows and various leaks around the edges of the vanes, etc . . . , an average value of 1.25 can be considered. A value of 10 for r is realistic enough. This means that the pressure ratio $P_2/P_a$ could reach 17 to 18/1. This corresponds to maximum values of $P_2$ of approximately 280 psia. As a reference, under such conditions, pressures previously mentoned are: $P_1 \cong 500$ psi, $P_i \cong 380$ to 400 psi, $\Delta P_i = 150$ psi on a standard day and at sea level.

The value of r is then $(1+P)^{mn}$ and $\Delta P = P^* \cdot (r^{1/mn} - 1)$. The number of stages must be 2 or 3 for practical reasons and the number of vanes per stage could be 3 to 4 in the case of FIG. 2 construction, 5 to 7 in the case of FIG. 3 construction 7 to 11 in the case of FIG. 4 construction and 8 and up in the case of FIG. 4 construction if "externally" located non-rotating vanes are used. By utilizing the equations derived and the reference pressure values given above, a reader well versed in the art will be able to determine the maximum values of ΔP that correspond to each combination of m and n values give above. In final analysis, experimental data will help and guide the designer in selecting the optimum values of ΔP that seem acceptable. Design considerations will establish optimum set of values for m and n. Again, considerations regarding the application, the space available for the engine and motor locations, and the operation mode of the engine will be determining factors also of any optimization process. Finally, the number of stages of each function may differ: i.e. two stages for the compression and three stages for the expansion, which seems particularly suitable for motor cnstructions using full-revolution single stage designs. A final remark well known of aerodynamicists/thermodynamicists may be applicable here: "it is easier to channel gases while they are being compressed than it is to guide them while they are being expanded". The remark applies to the degree of assurance that the vane contact with its track is always present.

During compression, the vane is pushed in by the track, whereas it is not being pulled out during expansion. Therefore it might be easier for ΔP to interfere with and prevent the making and maintaining of such contact. Adding an extra expansion stage provides two advantages: (1) it enables the designer to adopt two different sets of ΔP, i.e. lower for the expansion stages, and (2) it takes care of the extra amount of expansion which a DAVID Cycle (ad does a gas turbine cycle) requires. If the vanes perform the single function of gas expansion, tilting of the vanes could be made even more pronounced than was earlier discussed. Finally, the curvature of the track surface can be shaped so as to optimize the radial motion acceleration in a manner such that it enables the motor designer to maximize ΔP as a function of the degree of vane extension.

Material Selection:

Because cooling and/or lubrication of moving parts are altogether absent, all structural parts under stress must be made of materials that exhibit the following properties: (1) substantial high strength at temperatures up to 2,000° F., (2) low or nil thermal expansion, (3) fair thermal conductivity, (4) capability of being given a well polished hard surface, and (5) some resilience. Some high temperature steel alloys might qualify but are expensive. During the past two decades, great strides have been made in the development of two new classes of high temperature structural materials. They are ceramics and carbon/graphite composites of various natures. The latter are more advanced, more widely used and are chaeracterized by appealing qualities. They are described and discussed first.

The method used for carbonizing and densifying graphite composite materials reinforced with high strength carbonaceous filaments or fibers has been discussed previously. Fabrication methods have been used for some time now for making structures of quasi-revolution in which the reinforcing fibers are positioned along three orthogonal principal directions, so as to form structures that exhibit strength along three orthogonal axes. My U.S. Pat. No. 3,577,294 describes such a basic method. Modified manufacturing approaches are currently used.

Carbonaceous filaments are available either in carbon or graphite form. A discussion of the merits of each type in regard to the present application is beyond the scope of this disclosure. Carbon filaments and graphite fibers may be used jointly and combined in order to provide optimized qualities—i.e. low friction—in a preferential direction—i.e. track surface, rotor outer surface. A graphite matrix (carbonized densified material binding the fibers together) may provide good dry lubrication. The strength of both carbon and graphite increases with temperature up to the present application usage levels. Their thermal expansion is small and acceptable here. They are less brittle than ceramics and machinable. They have acceptable thermal conductivity. The matrix base material can be seeded with selected metals locally so as to form carbides at a late manufacturing stage by means of special heat treatment. Such carbide compounds are very hard and can enhance the in-depth composite hardness in specific spots, without requiring the mounting and/or attaching of another part. As an example, the rotor, the flanges and/or the external annular structures could be made with such materials tailored to match the specific local requirements of each part.

The tilting pads, the air journal sections, air supply tubes 126 with their associated bellows and shaft 31 are parts that typically should be made of steel alloys, for ease of fabrication. The reader familiar with the art will understand and appreciate the reasons for such choice. The vanes could also be made of carbon/graphite composite materials. However, ceramics could be suitable candidates, if vane chattering can be avoided with certainty. By nature, ceramics are brittle and a very minor crack may easily lead to a catastrophic part failure. They are hard, can be molded to various shapes, have small coefficients of thermal expansion and are strong at elevated temperatures. As a reminder, it should be noted that spaces 125 (or 125') are holes and do not consist of large flat thin-walled cavities extending throughout most of the vane internal volume. The rotors could also be made with ceramics. When rotor/vane assemblies are used for a single functon, the best and most suitable material being then be chosen for compression and expansion stages, materials of different nature can be considered for the rotor and/or vanes in one motor. As a point of interest, zirconium oxide is being investigated as a candidate material for some parts in Diesel engines.

Ceramics usually represent forms of chemical compounds of silicon, oxygen, carbon, boron, etc . . . with metals or even between themselves: i.e. $SiO_2$, SiC, etc . . . . Brittleness is their common trait. Considerable efforts are being made to develop compounds and/or crystalline structures in the compound that will decrease brittleness. Also, ceramic compounds may be tailored to exhibit little or nil thermal expansion, helping thermal shock resistance though of little interest in the present application. Hardness and strength at elevated temperatures are characteristic of them. It is believed that a sliding van motor in which mechanical friction is practically eliminated can thus be built with suitable materials so that the motor will operate satisfactorily without cooling and lubrication.

Potential Operating Problems and Solutions Therefor:

The absence of lubrication represents a considerable improvement in the elimination of by-products which could have a highly damaging effect in the present application: i.e. the clogging of orifices and/or coating or surfaces. The unwanted burning or chemical altering by heat of lubricating oil result in the creation of undesirable solid particles and/or adhering gummy deposits on surfaces. Soot resulting from the fuel combustion combines with such deposits. The end product is a build-up of material at locations where they interfere with the engine opertion. In the present application, two types of surfaces or locations are particularly sensitive to such deposits: the restricting orifices controlling the high pressure air servoflows. The most vulnerable orifices are the small fixed size calibrated holes that are particularly susceptible to clogging. The reader will easily understand why the obstruction of any controlling fixed size orifice could have disastrous consequences. Because the combustion of almost any fuel can be neither absolutely complete nor perfect, some minute amounts of sooty and condensible volatile products which may combine when the engine is turned off.

Normally, in an IC engines, the flow of air stops immediately when the ignition or fuel injection is shut off. A small amount of partially burned fuel and/or gaseous products is left in the cylinders. As the engine cools down, these volatiles fractions condense and gather on surrounding wall surfaces and may collect at low points or dry up right there on these surfaces to which small amount of sooty powder may stick. IC engines can withstand a considerable amount of such products, most of it ending in the oil and oil sump or filter. With no oil, oil sump and/or filter, the safest and most straightforward approach for preventing the formation and build-up of such deposits is to insure that no volatiles are left inside the motor after the engine is turned off.

Dry soot alone, during engine operation will be blown away by the flow of high velocity air through the orifices and volatiles in the combusted gas cannot condense then. The flow of high pressure air starts immediately when the engine is turned on and a small amount of this air is stored during the engine operation, thus that air is still available the instant the combustion process is stopped. From that time on, while all moving parts inside the dynamic combustor and/or the motor have stopped, high pressure air is permitted to keep flowing until the stored amount is expended. Therefore, all the cavities inside the dynamic combustor (free piston combustion member) and the motor are ventilated and their contents flushed out, while the walls of these cavities are still hot. At the beginning of this ventilation phase, because $P_2$ has dropped considerably, momentarily, a burst of hot air at sonic speed flows through the various orifices. The result of such action is the blowing away of any soot and loose particles in addition to ventilation. It is unlikely that the motor could stop with the same vane always in the same position, thus throughout the engine life, all vanes, their surfaces and orifices have the opportunity to receive the same cleaning treatment. Filters located upstream of an orifice would get clogged after a short while and remain so. Their use is not recommended here.

Filtering is of interest, though, for the air admitted in the compressor, the fuel and further for the high pressure air when it leaves compressor 60 of FIG. 1. Because wear is practically eliminated, solid particles should not be produced inside the engine. Thus, unless a solid chunk is chipped off apart, it is almost impossible to obstruct a fixed size restricting orifice. In the case of the variable size restricting orifices of a few thousandths of width but very long, one can understand how a deposit build-up of 0.002–0.003 inch thickness could considerably alter the apparent effective size of the orifice. The "sonic" cleaning earlier mentioned is particularly beneficial here, because of the high surface-to-area ratios involved. It is unlikely that deposits of the type referred to above could build up on such surfaces. However, small particles of 0.005 to 0.010-inch size, if introduced by chance in the high pressure air circuit, could get caught between them and cause damages. Thus, although not shown in the schematic drawing of FIG. 1, fine air filters easily accessible for cleaning and/or replacement should also be installed at the connections of high pressure air supply ducts with the structures of both dynamic combustor and motor. In conclusion, if adequate design and maintenance precautions are taken, normal operation of such external combustion engine, without cooling and lubrication, could go on indefinitely.

The absence of cooling means that the external surface of the motor will be hot. If the thermal conduction of the external structure material is high enough, with adequate thermal insulation from the environment, the temperatures of that external surface will not differ appreciably from place to place, even if single full-revolution expansion stages are used. For safety, to minimize heat losses and eliminate large temperature differentials on the motor external surface, high-temperature thermal insulation should be used and form and enveloping jacket. The same applies to the free piston combustor and to the storage tank as well.

Energy/Engine-Efficiency Loss:

The diverting of compressed air, its further compression to higher pressure levels and the generalized use of air gaps in order to eliminate friction is not free energywise. It is believed but not experimentally proven that eliminating friction, lubrication and cooling probably may cancel the major part, if not all, of the energy costs incurred in the generation of high pressure air. One should of course realize that some of that compression energy is extracted when this air mixes and expands with the combustion gas. That process is very inefficient though. It is intuitively felt that the control of manufacturing tolerances and the use of low thermal expansion materials could minimize this energy loss down to insignificant amounts.

Assuming no loss of contact between the vane free edges and the track surface, the percentage of energy expenditure needed to supply high pressure air to the motor at a two-third of maximum power rating has been estimated at less than five percents. This represents also a loss of efficiency of 5% or an increase in specific fuel consumption of 5%. It is believed that the gain realized from heat saving , friction reduction and expansion of the air servoflows makes up for at least that much. A similar amount of high pressure air is also used in the free piston combustor. Altogether, the net energy losses there are of the order of a few percents.

In final analysis, the specific fuel consumption of a frictionless external combustion engine having a compression ratio similar to that of modern gasoline IC engines and using a DAVID Cycle (full combusted gas expansion) falls between those of OTTO Cycle and DIESEL Cycle engines. The advantages in other areas, namely are: (1) burning of less refined an expensive fuels, (2) use of fuels not derived from crude oil, (3) production of considerably less pollutants, especially $N0_x$, and (4) much longer life. Other advantages of an indirect nature are more difficult to estimate: (1) smaller engine volume, (2) lower weight, (3) higher flexibility of installation (three major components connected by ducts), and (4) lower noise and vibration levels.

The production cost of such engine will be higher than that of piston engines. It is impossible to estimate cost savings indirectly resulting from the advantages listed above. They are far reaching however and are dicussed in some of my other pending applications. Isolating mechanically the combustion process from the energy extraction process opens a vast and completely unchartered domain. As an example, it enables a volumetric compression and expansion motor to operate like a gas turbine without being penalized by the shortcomings and constraints of gas turbines in which compression and expansion ratios are dependent upon rpm's. The slowing down of the combustion process is made possible which enables the burning of cheaper fuels. The combustion can take place at peak temperatures similar to those of Diesel engines, eliminating the production of nitrous oxides. These are easily identifiable advantages. The reader may visualize other indirect advantages derived from the non-use of liquid fossil fuels: (1) independence from third world nations, (2) entirely domestic fuel production, (3) fuel transportation and storage, etc . . . .

An external combustion engine necessarily requires means for compressing air and expanding the gases produced by the burning of fuel externally to such means. The resulting combusted gas is produced at a pressure which may be higher or lower than that of the compressed air, depending upon the combustion mode. By comparison, the combusted gas pressure is higher in OTTO Cycle IC engines, approximately equal in Diesel Cycle IC engines and in gas turbines slightly lower than the compressed air pressure. Because combustion occurs in a free piston combustor and because compression and expansion are not performed in the same chambers, two distinct opportunities are offered by the present and related inventions regarding the use of DAVID Cycle engines. The first, already mentioned, concerns the possibility to have expansion volumetric ratios exceed compression volumetric ratios, the second pertains to the possibility of causing the free piston to raise the combusted gas pressure above the compressed air pressure, as my U.S. patent application Ser. No. 789,451, dated 10/21/'85, and my U.S. Pat. No. 4,399,654 amongst others indicate. The second possibility is potentially available with Diesel engines, but not structurally practical. It is out of question for gas turbines. The first possibility is available and used in a gas turbines, but out of question for piston engines or the Wankel rotary engine as well, for obvious reasons.

Therefore, vane engines, that have very little or no potential as engines per se, have exceedingly attractive features when used only as the motor part of the engine and coupled with a free piston combustion member—motor meaning combination of separate compression and expansion means—as was made self evident herein. However, modified piston-type systems—especially rotary piston types—can be coupled with a free piston combustor and are not entirely excluded from future consideration. The reader familiar with the art will no doubt readily understand why the vane concept is of greater interest here and used as a preferred embodiment of the motor part of an external combustion engine. It is thought that the present invention will be understood from the foregoing description and discussion and that the forms hereinbefore described and discussed merely represent preferred and examplary embodiments of construction and arrangement of the parts thereof, without departing from the spirit and the scope of the invention.

Having thus described my invention, I now claim:

1. In combination:

an external combustion sliding-vane engine comprising a motor member including means for compressing ambient air and means for expanding the combusted gas resulting from the combustion of fuel in the compressed air, a combustion member for receiving compressed air from the motor member, mixing the fuel with compressed air, igniting the mixture and burning the fuel, and delivering the combusted gas to said motor member, and a shaft connecting the compressing and expanding means for delivering power by means of an external drive shaft, the motor member further including a plurality of generally cylindrical center bodies, a plurality of generally cylindrical hollow external structures surrounding and enclosing corresponding ones of the center bodies, a plurality of flanges supporting the center bodies and hollow external structures for relative rotation therebetween about the shaft axis, each center body and corresponding hollow external structure being positioned between a corresponding pair of adjacent flanges, the external hollow structures and the center bodies having continuously curved surfaces positoned to face each other, a plurality of radially extending vane means extending between each pair of adjacent flanges at a plurality of circumferentially spaced locations, each vane means extending from an outer facing surface of a corresponding center body to an inner facing surface of a corresponding external hollow structure to thereby define a plurality of substantially circumferentially spaced sealed spaces between the flanges and the circumferential facing surfaces, each of the vane means being slidable in a substantially radial direction with respect to its corresponding facing surfaces, the curvatures and relative positions of the facing surfaces being such that a first portion of the sealed spaces progressively decrease in volume and a second porion of said sealed spaces progressively increase in volume as relative rotation of the facing surfaces takes place, an air inlet at the location where the decreasing volume is largest, an air outlet at the location where the decreasing volume is smallest, a combusted gas inlet at the location where the increasing volume is smallest and a combusted gas outlet at the location where the increasing volume is largest, a length of a first portion of each vane means which is located between its corresponding facing surfaces varying and a second portion of the vane means being guided laterally in a sliding motion between a pair of opposing walls of a guiding and structurally restraining slot-shaped housing.

the guided laterally restrained first portion of each vane means and the center bodies being supported between the corresponding guiding surfaces by pressurized air cushion means; and a plurality of air cushions located between all sliding surfaces formed by the relative motions of the center bodies, the external structures, the vane means and the shaft each air cushion being formed in a shallow cavity positioned between two closely located contiguous sliding surfaces, said cavity being defined by a first sliding surface on one side and a generally matchingly-shaped second surface on the other side, the first and second surfaces being generally parallel, the second surface being surrounded by a third narrow surface substantially orthogonal to the first and second surfaces and extending around the perimeter of the second surface and rising to a fourth surface generally parallel to the first surface and forming the other associated cooperating sliding surface, the supporting means so provided by said plurality of air cushions further including:

means for supplying and ducting presurized air to each of the shallow cavities, a fixed size restricting orifice positioned in the ducting means between the air supplying means and each shallow cavity, means for enabling the presssurized air to leave each air cushion between its corresponding two sliding surfaces for venting into the corresponding sealed spaces, and means for enabling two cooperating air cushions to operate in opposition against two of the first surfaces, said surfaces being fixed and separated by a fixed distance, the air cushions being housed in a structural member to be guided by and restrained between said two first surfaces in its sliding motion, said structure extending between two of the fourth surfaces separated by a distance slightly smaller than the distance separating the two first surfaces, so as to form two gap openings, each one gap being positioned between associated cooperating first and fourth sliding surfaces, one gap opening becoming automatically larger when the other gap opening becomes smaller and vice-versa, whereby each gap opening created by the distance separating each pair of cooperating sliding surfaces along a perimeter of the corresponding cavity forms a variable area restricting orifice, thereby enabling the pressure inside the cavity to vary according to said distance between the two sliding surfaces, and whereby a guided and restrained structural member equipped with air cushions becomes automatically centered and is maintained in said centered position between the two guiding and restraining first surfaces.

2. The combination of claim 1 wherein the means for supplying pressurized air further includes:

means for further compressing the air already compressed by the compressing means of the motor; and means for drivingly connecting the motor member external drive shaft to the means for further air compression.

3. The combination of claim 1 wherein air cushions are provided between the second portion of each vane means and the walls forming the corresponding slot-shaped housing for opposing a moment exerted on the vane means and generated by the differences in the pressures existing in each of the two sealed spaces located on each side of the first portion of the vane means.

4. The combination of claim 1 wherein air cushions are provided between the vane means and its two guiding flanges for preventing the vane means from making solid contact with said flanges during the vane means sliding motion.

5. The combination of claim 1 wherein air cushions are provided between the shaft and supporting means mounted on the flanges for maintaining said shaft centered in said supporting means and for preventing solid contact between the sliding surfaces of the shaft and said supporting means during the shaft rotation.

6. The combination of claim 1 wherein the slot-shaped housings ar located in corresponding ones of the rotating center bodies.

7. The combination of claim 1 wherein the slot-shaped housings are located in corresponding ones of the external hollow structures.

8. The combination of claim 1 wherein all vane means located between a first center body and its corresponding hollow structure are used for air compression, and all vane means located between a second center body and its corresponding hollow structure are used for combusted gas expansion.

9. The combination of claim 1 wherein half of the vane means located between a center body and its corresponding hollow structure are used for air compression, and the other half of the vane means are used for combusted gas expansion.

10. The combination of claim 1 and further comprising a storage tank located between the motor member and the combustion member for receiving and temporarily storing compressed air, and for receiving and temporarily storing combusted gas, and including:

means located in the storage tank for keeping compressed air and combusted gas separated and for causing heat to be exchanged between the combusted gas and the compressed air; and ducting means for connecting the storage tank to the motor member and to the combustion member;

whereby cooler combusted gas are received by the motor member and warmer compressed air is received by the combustion member, thus increasing the thermodynamic efficiency of the engine and providing a small reserve of compressed air after the engine has beeturned off.

11. The combination of claim 1 wherein the spaces separating each pair of facing surfaces at their closest points are closed by a seal sliding on the surface of the structure housing the vane means guiding slots, said seal being held by the structure forming the other facing surface, and further comprising:

means for enabling the seal to maintain continuous contact with the surface on which it slides while exerting a controlled amount of pressure thereon; and means for enabling the seal surface to deform slightly so as to conform to the local shapes and variations thereof of said surface and to the vane means housing slot openings.

12. The combination of claim 1 wherein the furthest extending side edge of the first portion of the vane means near the facing surface on which it slides includes a tilting air-cushioned pad which extends substantially from one of the flanges to the adjacent one, said tilting pad comprising:

hinge means for enabling the pad to tilt for conformance to variations in contour of the facing surface on which it rides;

means for forming a first air cushion located between a male portion of the hinge means mounted on the vane means and a female portion of the hinge means forming part of the pad structure;

means for forming a second air cushion located between the air pad and its cooperating facing surface;

means for forming a pair of third air cushions, one cushion of a pair being located between the pad end and the associated flange surface on which it slides; and ducting means located in the vane means structure for distributing pressurized air in each one of the air cushion cavities;

whereby the air pad structure is prevented from making solid contact with the surface on which the pad slides and rides, thus preventing the vane means from contacting the facing surface which controls the amount of the first porton extension.

13. The combination of claim 1 wherein the center bodies are slidably mounted on the shaft by means of spline means so as to enable said center bodies to move freely in the direction of the shaft axis between adjacent flanges, said center bodies further including a pair of air cushions, one of each such pari being located between one of the two flat end surfaces of the center body and a corresponding flat surface of the guiding and restraining flange, said air cushions further including:

ducting means located in the center body for supplying pressurized air to the air cushion cavities; and means for providing a narrow separation distance between the corresponding cooperating flat surfaces of the flange and of the associated center body.

* * * * *